US007024135B2

(12) United States Patent
Nagahama et al.

(10) Patent No.: US 7,024,135 B2
(45) Date of Patent: Apr. 4, 2006

(54) DEVELOPER CONTAINER AND IMAGE FORMING APPARATUS

(75) Inventors: Hitoshi Nagahama, Uji (JP); Masanobu Deguchi, Kashiba (JP); Kazuya Koyama, Ikoma (JP); Shigeki Hayashi, Ikoma-gun (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 10/967,050

(22) Filed: Oct. 15, 2004

(65) Prior Publication Data

US 2005/0265752 A1 Dec. 1, 2005

(30) Foreign Application Priority Data

Oct. 17, 2003 (JP) ..... P2003-357936

(51) Int. Cl.
*G03G 15/04* (2006.01)

(52) U.S. Cl. ..... 399/119; 399/262

(58) Field of Classification Search ..... 399/119, 399/262

See application file for complete search history.

(56) References Cited

U.S. PATENT DOCUMENTS

| | | | | |
|---|---|---|---|---|
| 5,455,662 A | | 10/1995 | Ichikawa et al. | |
| 5,500,719 A | | 3/1996 | Ichikawa et al. | |
| 5,627,631 A | | 5/1997 | Ichikawa et al. | |
| 5,822,663 A | | 10/1998 | Ichikawa et al. | |
| 5,913,097 A | * | 6/1999 | Nakano et al. | 399/256 |
| 5,918,090 A | | 6/1999 | Ichikawa et al. | |
| 6,075,963 A | | 6/2000 | Ichikawa et al. | |
| 6,104,902 A | * | 8/2000 | Meyer et al. | 399/262 |
| 6,289,195 B1 | | 9/2001 | Ichikawa et al. | |
| 6,292,644 B1 | * | 9/2001 | Goto et al. | 399/262 |
| 6,334,037 B1 | * | 12/2001 | Ise | 399/262 |
| 6,418,293 B1 | | 7/2002 | Ichikawa et al. | |
| 6,751,431 B1 | | 6/2004 | Ichikawa et al. | |
| 2004/0161267 A1 | | 8/2004 | Ichikawa et al. | |

FOREIGN PATENT DOCUMENTS

| | | |
|---|---|---|
| JP | 06-348127 | 12/1994 |
| JP | 7020705 | 1/1995 |
| JP | 08-305149 | 11/1996 |
| JP | 08-339115 | 12/1996 |
| WO | WO 2004/081673 | 9/2004 |

* cited by examiner

*Primary Examiner*—David M. Gray
*Assistant Examiner*—Ryan D. Walsh
(74) *Attorney, Agent, or Firm*—Edwards Angell Palmer & Dodge LLP; George W. Neuner

(57) ABSTRACT

The developer container includes a cylindrical container main body and a supporting member. The container main body includes a concavity and a discharge hole. The supporting member covers a portion containing the concavity and the discharge hole all over the circumference and rotatably supports the container main body, and includes a leading through hole for guiding the developer outside. A container side guide portion is arranged close to the concavity of the container main body. The container side guide portion elastically comes into contact with the inner circumferential portion of the supporting member so as to guide the developer located between the container main body and the supporting member, into the concavity. A supporting side guide portion is arranged close to the leading through hole of the supporting member, for guiding the developer located between the container main body and the supporting member, into the leading through hole.

7 Claims, 29 Drawing Sheets

DEVELOPER CONTAINER AND IMAGE FORMING APPARATUS

BACKGROUND OF THE INVENTION

1. Field of the Invention

The present invention relates to a toner container for accommodating toner used for forming an image by the electrophotographic system. The invention also relates to an image forming apparatus to which the toner container is detachably attached.

2. Description of the Related Art

FIG. 31 is a perspective view showing a conventional developer supplying container 1. The typical prior art is described in Japanese Unexamined Patent Publication JP-A 8-339115 (1996). The developer supplying container 1 described in JP-A 8-339115 is formed into a cylindrical shape, both ends of which are closed, and a toner accommodating space for accommodating toner is provided in the developer supplying container 1. The developer supplying container 1 includes: a first projection piece 4 protruding inward in the radial direction, extending spirally round axis L1 from one end portion 2 in the axial direction to the central portion 3 in the axial direction; and a second projection piece 6 protruding inward in the radial direction, extending spirally round axis L1 from the other end portion 5 in the axial direction to the central portion 3 in the axial direction. At the center 3 of the developer supplying container 1 in the axial direction, the through-hole 7 is formed which penetrates the developer supplying container 1 in the radial direction so that the accommodating space can be communicated with the outer space of the developer supplying container 1 by the through-hole 7.

The developer supplying container 1 is connected to an image forming apparatus main body not shown in the drawing so that axis L1 can be arranged in parallel with the horizontal direction in such a manner that the central portion 3 in the axial direction can face a toner supplying port which is provided in the image forming apparatus so that the toner supplying port can open upward. In this state, the developer supplying container 1 is rotated round axis L1 by a driving force given from a driving portion provided in the image forming apparatus main body. Due to the foregoing, the toner accommodated in the accommodating space in the developer supplying container 1 is conveyed to the central portion 3 in the axial direction by the projection pieces 4, 6. When the through-hole 7 is located at a position where the through-hole 7 faces the toner supply port, the toner is supplied to the toner supplying port via the through-hole 7.

FIG. 32 is a perspective view showing another conventional toner cartridge 10. Another typical prior art is described in Japanese Unexamined Patent Publication JP-A 6-348127 (1994). The toner cartridge 10 described in JP-A 6-348127 is formed into a cylindrical shape, both end portions of which are closed so that a toner accommodating space for accommodating toner can be provided in the toner cartridge 10. At the central portion 11 of the toner cartridge 10 in the axial direction, the through-hole 12 is formed which extends in the axial direction and penetrates the toner cartridge 10 in the radial direction so that the toner accommodating space and the outer space of the toner cartridge 10 can be communicated with each other by the through-hole 12.

The toner cartridge 10 is connected to an image forming apparatus main body not shown in the drawing so that axis L10 can be arranged in parallel with the horizontal direction in such a manner that the central portion in the axial direction can face a toner supplying port which is provided in the image forming apparatus so that the toner supplying port can open upward. In this state, the toner cartridge 10 is rotated round axis L10 by a driving force given from a driving portion provided in the image forming apparatus main body. Due to the foregoing, the toner accommodated in the accommodating space of the toner cartridge 10 is conveyed to the toner supplying port via the through-hole 12 when the through-hole 12 is located at a position where the through-hole 12 faces the toner supply port.

In the developer supplying container 1 described before, when the toner which has been discharged from the developer supplying container 1 is going to leak into between the developer supplying container 1, which is rotating round axis L1, and the image forming apparatus main body, the toner to leak out must be guided to the toner supply port by a toner guiding means. However, no disclosure and suggestion are made for the means for guiding the toner, which is going to leak out, into the toner supplying port.

In the toner cartridge 10 described before, when the toner which has been discharged from the toner cartridge 10 is going to leak into between the toner cartridge 10, which is rotating round axis L10, and the image forming apparatus main body, the toner to leak out must be guided to the toner supply port by a toner guiding means. However, no disclosure and suggestion are made for the means for guiding the toner, which is going to leak out, into the toner supplying port.

SUMMARY OF THE INVENTION

It is an object of the invention to provide a developer container capable of guiding the developer from between the outer circumferential portion of the container main body and the inner circumferential portion of the supporting member into a concavity provided in the container main body and further capable of guiding the developer into the guide hole of the supporting member. It is another object of the invention to provide an image forming apparatus on which the developer container can be detachably mounted.

The invention provides a developer container that is detachably mounted on an image forming apparatus, comprising:

a container main body for accommodating developer used for image formation, formed into a cylindrical shape, a concavity sinking inward in the radial direction being formed in an outer circumferential portion of the container main body, a discharge hole for discharging developer being formed in the container main body, the developer accommodated in the container main body being conveyed to the discharge hole when the container main body is rotated round its axis;

a supporting member for covering a portion including at least the concavity and the discharge hole from the outside in the radial direction all over the circumference, for supporting the container main body so that the container main body can be freely rotated round its axis, the supporting member being formed facing a moving passage of the concavity by the rotation of the container main body, a leading through hole for guiding the developer discharged from the discharge hole of the container main body to the outside being provided in the supporting member; and a container side guide portion for guiding the developer from between the outer circumferential portion of the container main body and the inner circumferential portion of the supporting member into the concavity by the rotation of the container main body, the container side guide portion elastically coming into contact with the inner circumferential portion of the supporting member, the container side guide portion being arranged in a neighborhood of the concavity on one side and the other side in the axial direction of the outer circumferential portion of the container main body.

In the invention it is preferable that the container side guide portion is arranged so that the container side guide portion can come close to the concavity as it comes to an upstream side in the rotation direction.

In the invention it is preferable that the container side guide portion is formed into a sheet-shape having flexibility and elasticity, the container side guide portion protrudes outside in the radial direction, and a free end portion of the container side guide portion elastically comes into contact with the inner circumferential portion of the supporting member.

In the invention it is preferable that the container side guide portion includes a plurality of guiding pieces protruding outside in the radial direction.

In the invention it is preferable that the developer container includes a supporting side guide portion for guiding the developer from between the outer circumferential portion of the container main body and the inner circumferential portion of the supporting member into the leading through hole, the supporting side guide portion being arranged in a neighborhood of the leading through hole of the inner circumferential portion of the supporting member.

In the invention it is preferable that the supporting side guide portion is formed into a sheet-shape having flexibility and elasticity and protrudes inward in the radial direction, and a free end portion of the supporting side guide portion elastically comes into contact with the outer circumferential portion of the container main body.

The invention provides an image forming apparatus into which the developer container is detachably incorporated.

According the invention, the container main body is formed into a cylindrical shape for accommodating developer used for image formation. In the outer circumferential portion of the container main body, the concavity is provided which sinks inward in the radial direction, and further the discharge hole for discharging developer is provided. When the container main body is rotated round its axis, the accommodated developer is conveyed toward the discharge hole. The supporting member covers a portion including at least the concavity and the discharge hole all over the circumference from the outside in the radial direction and supports the container main body so that the container main body can be freely rotated round its axis. There is provided a leading through hole which is formed facing a moving passage of the concavity by the rotation of the container main body, and the developer discharged from the discharge hole of the container main body is guided outside by the leading through hole. In the neighborhood of the concavity on one side and the other side in the axial direction of the concavity of the outer circumferential portion of the container main body, the container side guide portion is further provided which elastically comes into contact with the inner circumferential portion of the supporting member and guides the developer from between the outer circumferential portion of the container main body and the inner circumferential portion of the supporting member to the concavity by the rotation of the container main body. Even in the case where the developer is going to stay in a portion between the outer circumferential portion of the container main body and the inner circumferential portion of the supporting member or the developer is going to leak outside by the rotation of the container main body, the developer is guided by the concavity of the container side guide portion. Therefore, the developer can be prevented from staying in the portion between the outer circumferential portion of the container main body and the inner circumferential portion of the supporting member or the developer can be prevented from leaking outside. Due to the foregoing, it is possible to prevent the occurrence of a problem in which the rotation of the container main body is blocked when the developer stays between the outer circumferential portion of the container main body and the inner circumferential portion of the supporting member. Therefore, the developer can be stably discharged from the leading through hole.

According to the invention, the container side guide portion is arranged so that the container side guide portion can come close to the concavity as it comes toward the upstream side in the rotation direction. Therefore, the developer between the outer circumferential portion of the container main body and the inner circumferential portion of the supporting member can be guided into the concavity by the rotation of the container main body.

According to the invention, the container side guide portion is formed into a sheet-shape having flexibility and elasticity and protrudes outward in the radial direction, and a free end portion elastically comes into contact with the inner circumferential portion of the supporting member. Therefore, it is possible to reduce a contact area in which the container side guide portion and the inner circumferential portion of the supporting member are contacted with each other. Due to the foregoing, it is possible to reduce a frictional force in the opposite direction to the rotation direction of the container main body which is generated when the container side guide portion elastically comes into contact with the inner circumferential portion of the supporting member, so that the container main body can be smoothly rotated.

According to the invention, the container side guide portion includes a plurality of guide pieces protruding outward in the radial direction. In the case where the container side guide portion is a flexible and elastic sheet, it is necessary that the container side guide portion is previously formed into a shape, which is the same as the outer circumferential portion of the container main body, and then attached to the outer circumferential portion of the container main body. However, when the container side guide portion includes a plurality of guide pieces, it is unnecessary to do the thing described above and it is easy to provide the container guide portion in the outer circumferential portion of the container main body.

According to the invention, in the neighborhood of the leading through hole of the inner circumferential portion of the supporting member, the supporting side guide portion is provided which guides the developer from between the outer circumferential portion of the container main body and the inner circumferential portion of the supporting member to the leading through hole. Even in the case where the developer between the outer circumferential portion of the container main body and the inner circumferential portion of the supporting member is going to stay in the portion or leak outside by the rotation of the container main body, the developer is guided to the leading through hole by the supporting side guide portion. Therefore, the developer can be prevented from staying in the portion and leaking outside. When the supporting side guide portion and the container side guide portion cooperate with each other, it becomes possible to prevent the container main body from being blocked by the developer staying between the outer circumferential portion of the container main body and the inner circumferential portion of the supporting member, and the developer can be stably, positively discharged from the leading through hole.

According to the invention, the supporting side guide portion is formed into a sheet shape having flexibility and elasticity and protruded inward in the radial direction, and a free end portion of the supporting side guide portion elastically comes into contact with the outer circumferential portion of the container main body. Therefore, it is possible to reduce a contact area in which the supporting side guide portion and the outer circumferential portion of the container main body are contacted with each other. Due to the foregoing, it is possible to reduce a frictional force in the opposite direction to the rotation direction of the container main body which is generated when the supporting side guide portion elastically comes into contact with the outer circumferential portion of the container main body, so that the container main body can be smoothly rotated.

According to the invention, an image forming apparatus can be detachably attached with the developer container capable of accomplishing the above effects.

BRIEF DESCRIPTION OF THE DRAWINGS

Other and further objects, features, and advantages of the invention will be more explicit from the following detailed description taken with reference to the drawings wherein.

DETAILED DESCRIPTION

Figure 1:
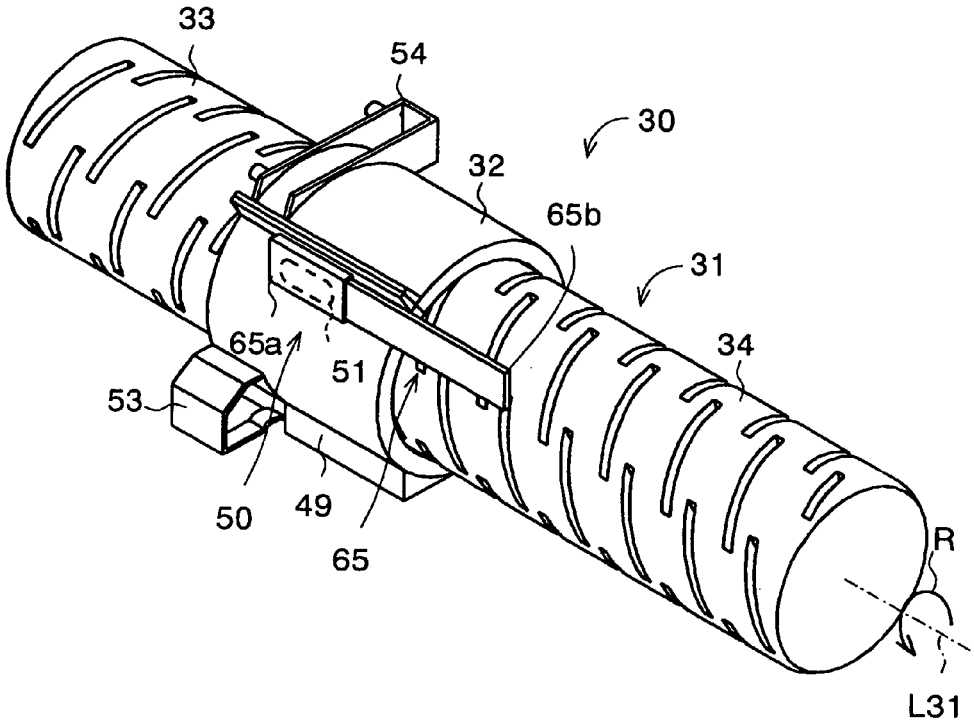
FIG. 1 is a perspective view showing a developer container according to an embodiment of the invention.

Now referring to the drawings, preferred embodiments of the invention are described below.

Figure 2:
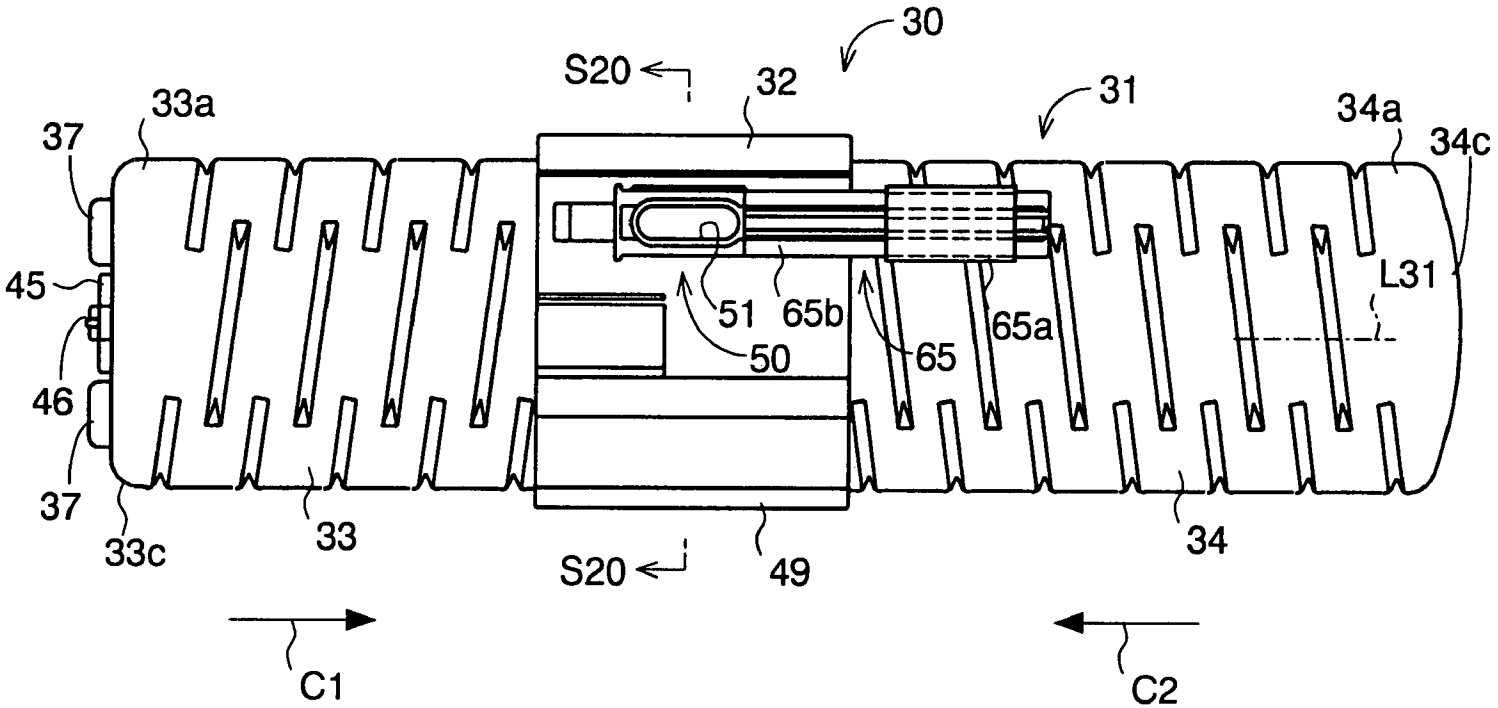
FIG. 2 is a front view showing the developer container.
Figure 3:
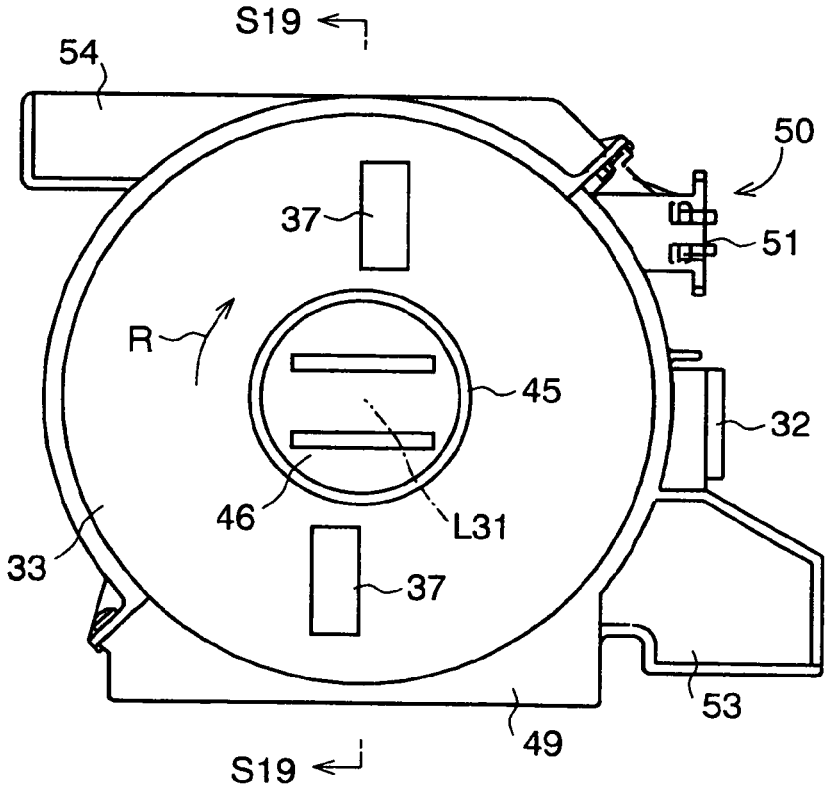
FIG. 3 is a left side view showing the developer container.

FIG. 1 is a perspective view showing a developer container 30 according to an embodiment of the invention. FIG. 2 is a front view showing the developer container 30. FIG. 3 is a left side view showing the developer container 30. The developer container 30 includes: a container main body 31; and a supporting member 32. The container main body 31 is formed into a substantially cylindrical shape, in which developer such as colored toner, which is used for forming an image by the electrophotographic system, is accommodated. The supporting member 32 pivotally supports the container main body 31 so that the container main body 31 can be freely rotated round axis L31. For example, the developer container 30 is capable of accommodating developer of 1400 grams. Axis L31 of the container main body 31 will be described as rotation axis L31 hereinafter.

Figure 4:
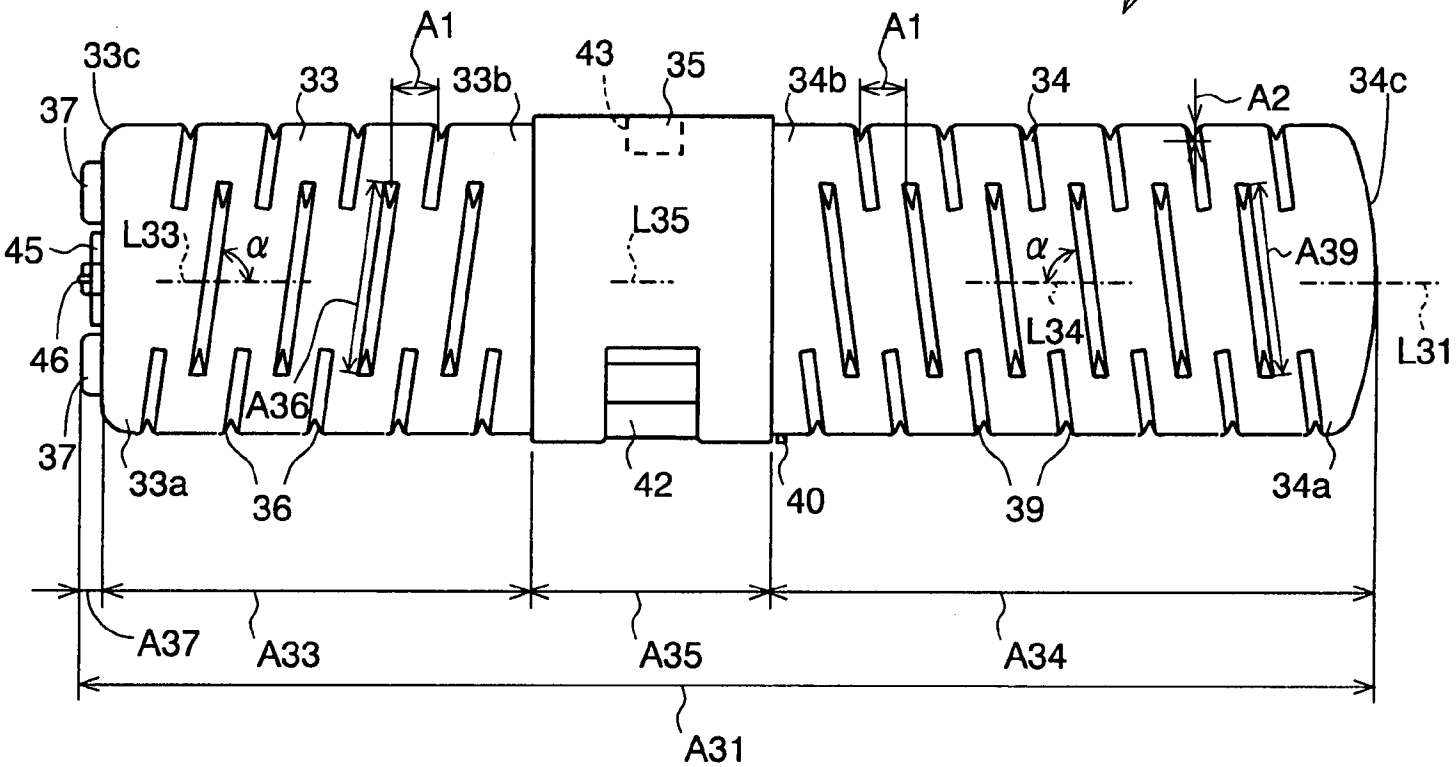
FIG. 4 is a front view showing a container main body.
Figure 5:
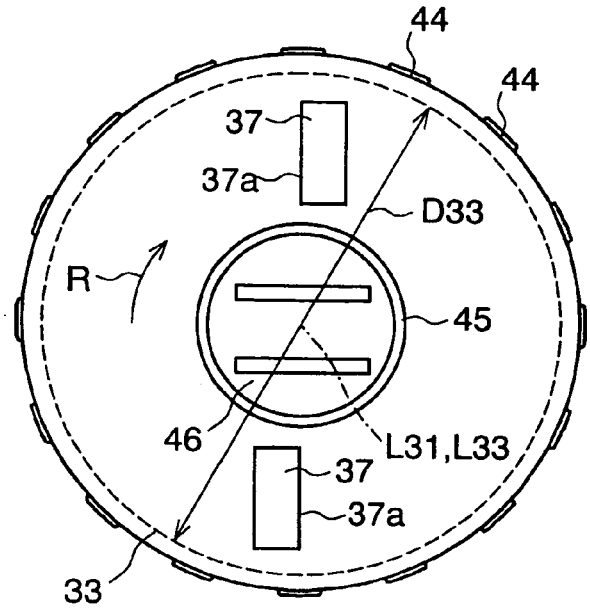
FIG. 5 is a left side view showing the container main body.
Figure 6:
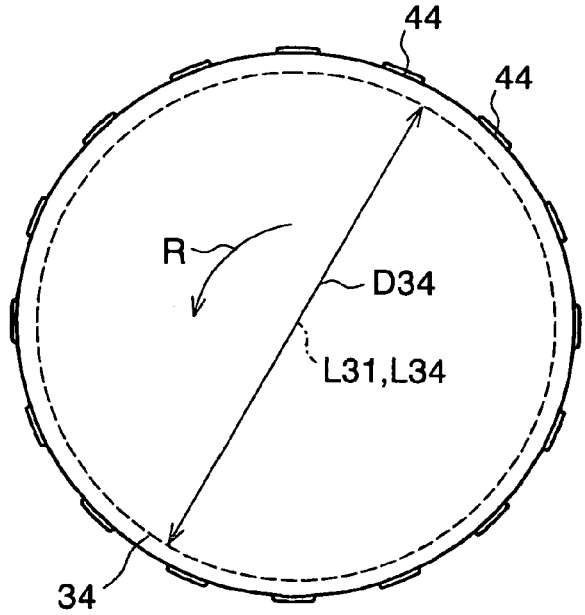
FIG. 6 is a right side view showing the container main body.

FIG. 4 is a front view showing the container main body 31. FIG. 5 is a left side view showing the container main body 31. FIG. 6 is a right side view showing the container main body 31. The container main body 31 includes: a first container segment 33; a second container segment 34; and a third container segment 35. Length A31 in the axial direction L31 of the container main body 31 can be arbitrarily set. For example, length A31 in the axial direction L31 of the container main body 31 can be set at 458 mm.

The first container segment 33 is formed into a cylindrical shape having a bottom. Length A33 in the axial direction of the first container segment 33 can be arbitrarily set. For example, length A33 in the axial direction of the first container segment 33 can be set at 160 mm. In the inner circumferential portion of the first container segment 33, a means for conveying developer in the axial direction by rotating the first container segment 33 round axis L31 is provided. As shown in FIG. 4, the conveying means includes first projection pieces 36 which are a plurality of conveying portions extending in the first extending direction from the opening end portion 33*b*, which is another end portion in the axial direction of the first container segment 33, to the bottom portion 33*a*, which is one end portion in the axial direction and protruding inward in the radial direction, as it is directed to the downstream side in the rotation direction. Two first projection pieces 36 are formed at intervals in the circumferential and the axial direction. The first projection pieces 36, which are adjacent to each other in the axial direction are arranged, so that a downstream side end portion in the rotation direction of one first projection piece 36 can be adjacent to an upstream side end portion in the axial direction of the other first projection piece 36. The first projection pieces 36 are described in detail as follows. Each first projection piece 36 is formed being inclined and extended into an arc shape so that the downstream end portion in the rotation direction can be arranged on the bottom portion 33*a* side as compared with the upstream side end portion in the rotation direction.

As shown in FIGS. 4 and 5, the bottom portion 33*a* of the first container segment 33 includes: an convex fit 37 which is a connecting portion protruding from the opening end portion 33*b* to the bottom portion 33*a*; and a replenishment port 45. A plurality of convex fits 37 are formed. In this embodiment, two convex fits 37 are formed. The replenishment port 45 is formed at the center of the bottom portion 33*a* of the first container segment 33 in such a manner that the replenishment port 45 penetrates the first container segment 33 in the direction of rotation axis L31 and is open into a circular shape, the axis of which is the same as the axis L33 of the first container segment 33. The replenishment lid 46, the shape of which is formed corresponding to the shape of the replenishment port 45, which can be detachably attached to the replenishment port 45, is airtightly attached to the replenishment port 45 so that the replenishment lid 46 can not be detached from it even when the container main body 31 is rotated. When the replenishment lid 46 is detached from the replenishment port 45, the inner space and the outer space of container main body 31 are communicated with each other. Developer can be supplied to the container main body 31 under the above condition.

The convex fits 37 will be described in detail as follows. The convex fits 37 are arranged outside the replenishment port 45 in the radial direction at positions substantially symmetrical to each other with respect to the axis L33 of the first container segment 33. The convex fits 37 will be described in more detail as follows. As shown in FIG. 5, the upstream side portion 37*a* in the rotation direction R, which is a rotation direction of clockwise round the rotation axis L31 when it is viewed from the bottom portion 33*a* of the first container segment 33, is formed so that the upstream side portion 37*a* can have a plane extending vertically in the circumferential direction. The downstream side portion in the rotation direction R of the convex fit 37 is formed so that the downstream side portion can be inclined to the other end portion side in the axial direction as it comes to the downstream side in the rotation direction R. A protruding length A37 from the residual portion of the bottom portion 33*a* of the convex fit 37 in the direction of the axis L33 can be arbitrarily set, for example, the protruding length A37 can be set at 8 mm. The thus composed convex fit 37 can be attached to and detached from the main body-side coupling section 83 (shown in FIG. 29) provided in the image forming apparatus 70 described later.

As shown in FIG. 4, the face 33*c* for communicating the outer circumferential face with the end face in the bottom portion 33*a* of the first container segment 33 is formed into a curved face which inclines inward in the radial direction as it comes from the opening end portion 33*b* to the bottom portion 33*a*.

The second container segment 34 is formed into a cylindrical shape having a bottom portion. Length A34 in the axial direction of the second container segment 34 can be arbitrarily set. For example, length A34 in the axial direction of the second container segment 34 can be set at 210 mm. In the inner circumferential portion of the second container segment 34, a means for conveying developer in the axial direction by rotating the second container segment 34 round axis L31 is provided. As shown in FIG. 4, the conveying means includes second projection pieces 39 which are a plurality of conveying portions extending in the second extending direction from the opening end portion 34*b*, which is one end portion in the axial direction of the second container segment 34, to the bottom portion 34*a*, which is another end portion in the axial direction and protruding inward in the rotation direction, as it is directed to the downstream side in the rotation direction. The second projection pieces 39 are formed at intervals in the circumferential and the axial direction. Two first projection pieces 39, which are adjacent to each other in the axial direction, are arranged so that a downstream side end portion in the rotation direction of one second projection piece 39 can be adjacent to an upstream side end portion in the axial direction of the other second projection piece 39. The second projection pieces 39 are described in detail as follows. Each second projection piece 39 is formed being inclined and extended into an arc shape so that the downstream end portion in the rotation direction can be arranged on the bottom portion 34*a* side as compared with the upstream side end portion in the rotation direction.

The length A34 in the axial direction of the second container segment 34 is set longer than the length A33 in the axial direction of the first container segment 33, for example, by a length not less than 30 mm. As described before, the length A33 in the axial direction of the first container segment 33 can be set at an arbitrary value, for example, the length A33 in the axial direction of the first container segment 33 can be set at 150 mm. The length A34 in the axial direction of the second container segment 34 can be set at an arbitrary value, for example, the length A34 in the axial direction of the second container segment 34 can be set at 215 mm. Further, the inner diameter D33 of the inner circumferential portion except for the first projection piece 36 of the first container segment 33 and the inner diameter D34 of the inner circumferential portion except for the second projection piece 39 of the second container segment 34 can be set at an arbitrary value, for example, at 105 mm. The interval A1 of a pair of the first projection pieces 36 and a pair of the second projection pieces 39, which are adjacent to each other in the axial direction, can be set at an arbitrary value, for example, at 15 mm.

It is preferable that the length A36 in the first extending direction of the first projection piece 36 and the length A39 in the second extending direction of the second projection piece 39 are not less than 1/16 and not more than 3/8 of the inner circumferential length of the first container segment 33 and the inner circumferential length of the second container segment 34. When the length A36 in the first extending direction of the first projection piece 36 and the length A39 in the second extending direction of the second projection piece 39 are shorter than 1/16 of the inner circumferential length of the first container segment 33 and the inner circumferential length of the second container segment 34, the developer conveying capacity is decreased. When the length A36 in the first extending direction of the first projection piece 36 and the length A39 in the second extending direction of the second projection piece 39 are longer than 3/8 of the inner circumferential length of the first container segment 33 and the inner circumferential length of the second container segment 34, the mechanical strength of the container main body 31 is decreased, which is not preferable. When the conveying capacity of the first projection piece 36 and the second projection piece 39 is too large, coagulation of the developer may be caused in the neighborhood of the discharge hole, which is not preferable. In this embodiment, the length A36 in the first extending direction of the first projection piece 36 and the length A39 in the second extending direction of the second projection piece 39 can be at an arbitrary value, for example, at 60 mm. An interval of the two first projection pieces 36, which are adjacent to each other in the circumferential direction, and an interval of the two second projection pieces 39, which are adjacent to each other in the circumferential direction, can be set at an arbitrary value, for example, at 50 mm.

The protruding length A2 of the first projection piece 36 and the second projection piece 39 from the residual portions of the inner circumferential portions of the first container segment 33 and the second container segment 34 inward in the radial direction is preferably not less than 1 mm and not more than 10 mm. When protruding length A2 is longer than 10 mm, the developer conveying capacities of the first projection piece 36 and the second projection piece 39 can be increased, however, when the developer conveying capacities are too large, there is a possibility that the developer is coagulated in the neighborhood of the discharge hole, which is not preferable. When the protruding length A2 is longer than 10 mm, it becomes difficult for the first projection piece 36 and the second projection piece 39 to be formed by means of blow molding. On the contrary, when the protruding length A2 is shorter than 1 mm, the developer conveying capacity is decreased, and it becomes impossible to convey a sufficient quantity of developer to the discharge hole. In the embodiment, for example, the protruding length A2 of the first projection piece 36 and the second projection piece 39 from the residual portions of the inner circumferential portions of the first container segment 33 and the second container segment 34 may be 6 mm. When the numbers of the first projection pieces 36 and the second projection pieces 39 are large, the developer conveying capacity can be enhanced. In the embodiment, the number of the first projection pieces 36 may be 26, and the number of the second projection pieces 39 may be 38.

The angle $\alpha$, which is formed between the tangents of the first projection piece 36 and the second projection piece 39 and the tangents of the circumferential directions of the first container segment 33 and the second container segment 34, is not less than 2° and not more than 45°. It is preferable that the angle $\alpha$ is not less than 5° and not more than 30°. In the embodiment, for example, the angle $\alpha$ may be approximately 9° The developer conveying capacity of the container main body 31 is determined by the geometrical conditions of the first projection piece 36 and the second projection piece 39 described before. Therefore, the developer conveying capacity of the container main body 31 is determined so that an appropriate quantity of developer can be always discharged from the discharge hole 43 in all states from the state in which the container main body 31 is filled with the developer to the state in which the developer has been completely discharged.

At least the face for communicating the outer circumferential face with the end face in the bottom portion 34*a* of the second container segment 34 is formed into a curved face which inclines inward in the radial direction as it comes from the opening end portion 34*b* to the bottom portion 34*a*. The detail will be described as follows. The end face 34*c* of the bottom portion 34*a* of the second container segment 34 is formed into a partially spherical shape, the central portion of which is protruded from the opening end portion 34*b* to the bottom portion 34*a*. In the outer circumferential portion located between the end face of the opening end portion 34*b* of the second container segment 34 and the bottom portion 34*a*, a plurality of guiding projection pieces 40, which protrude outward in the radial direction, are arranged in the circumferential direction at intervals. In the embodiment, two guiding projection pieces 40 are arranged. The size of the guiding projection piece 40 in the axial direction can be set at an arbitrary value, for example, the size of the guiding projection piece 40 in the axial direction may be set at 2.5 mm.

Figure 7:
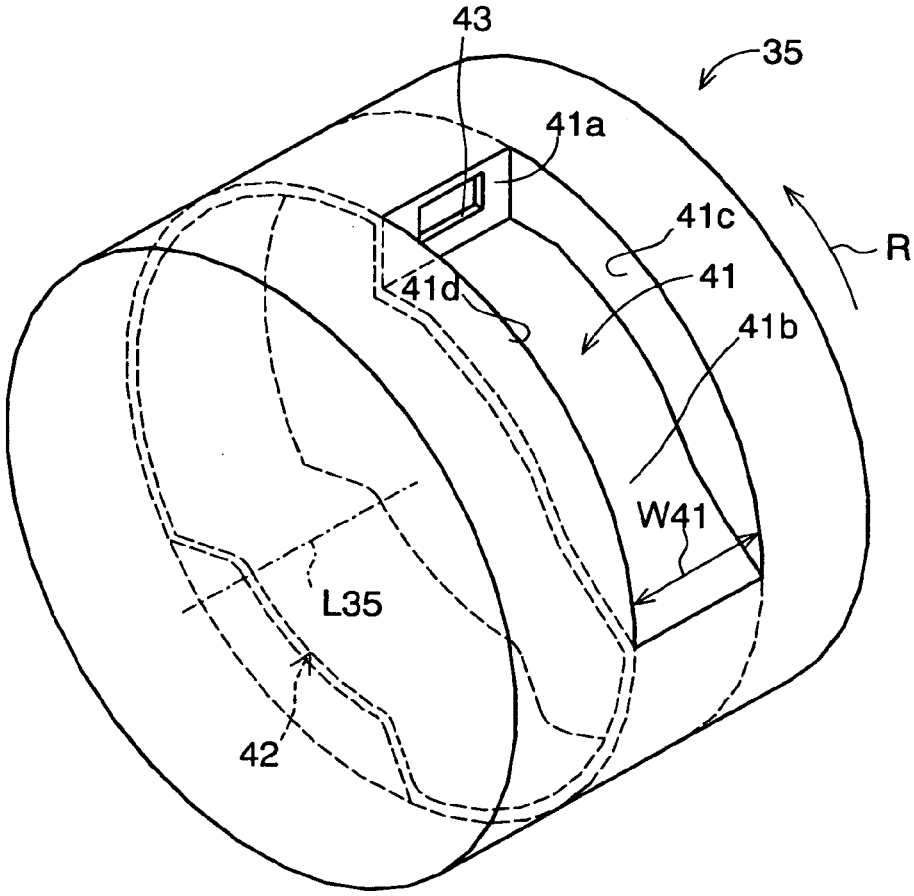
FIG. 7 is a perspective view showing a third container segment, wherein the view is taken from a first concavity side.
Figure 8:
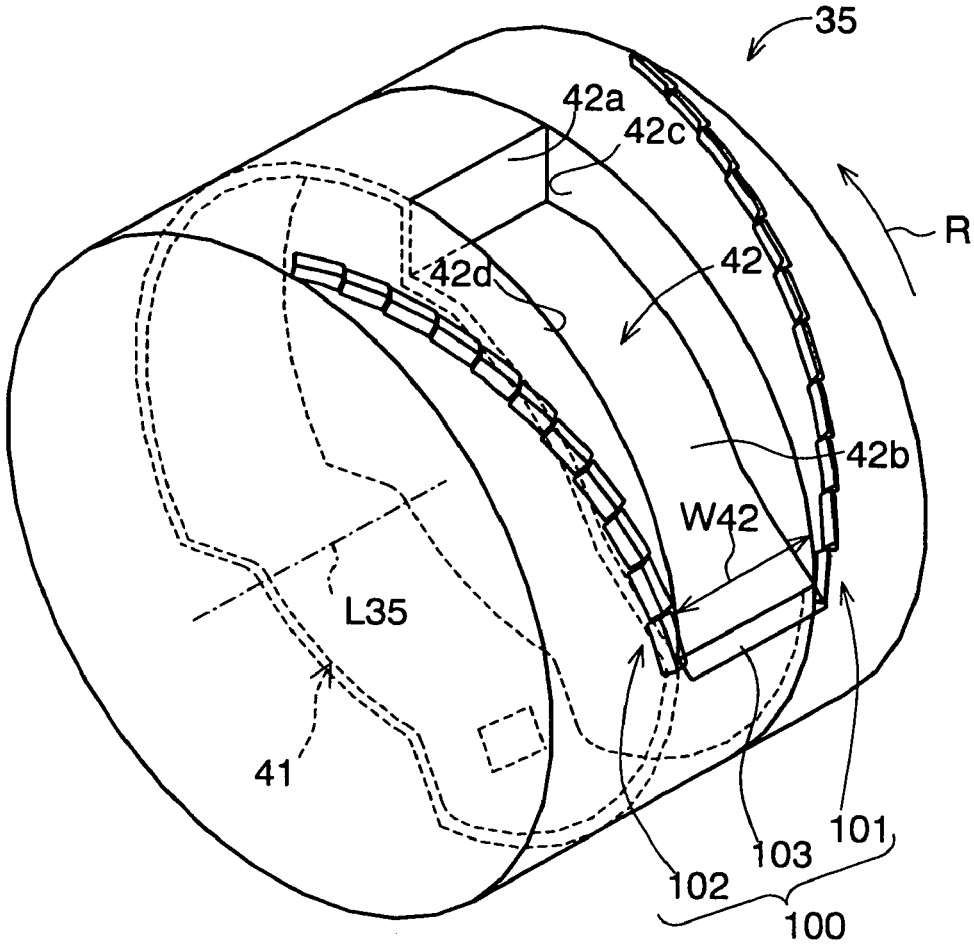
FIG. 8 is a perspective view showing the third container segment, wherein the view is taken from a second concavity side.
Figure 9:
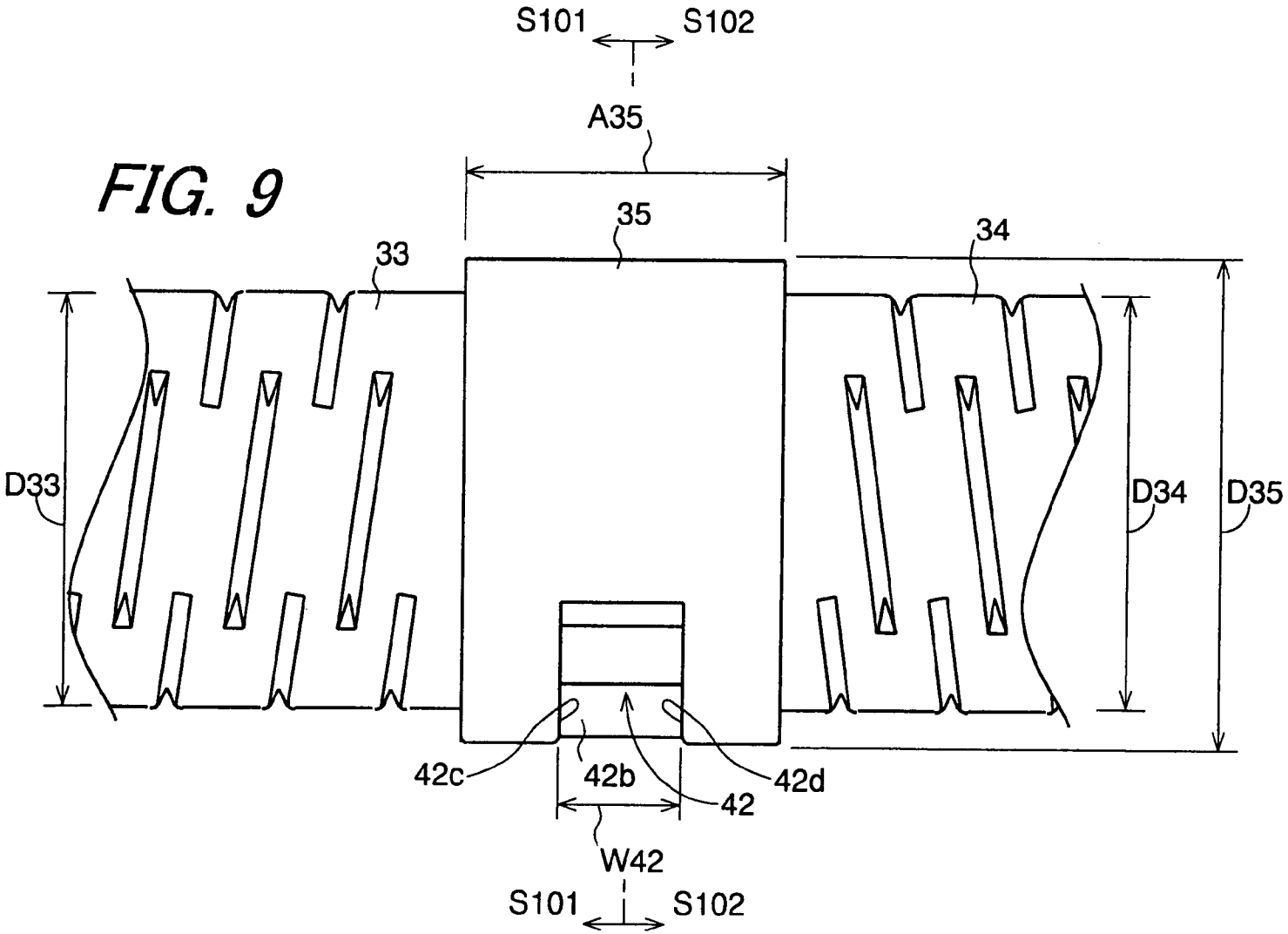
FIG. 9 is an enlarged front view showing the third container segment.
Figure 10A:
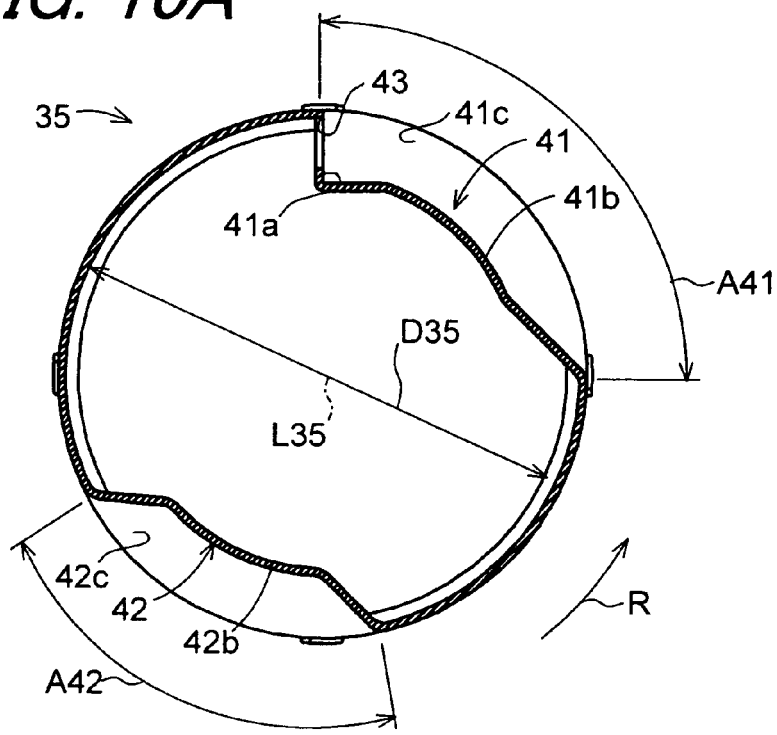
FIG. 10A is a sectional view taken on a line S101—S101 in FIG. 9.
Figure 10B:
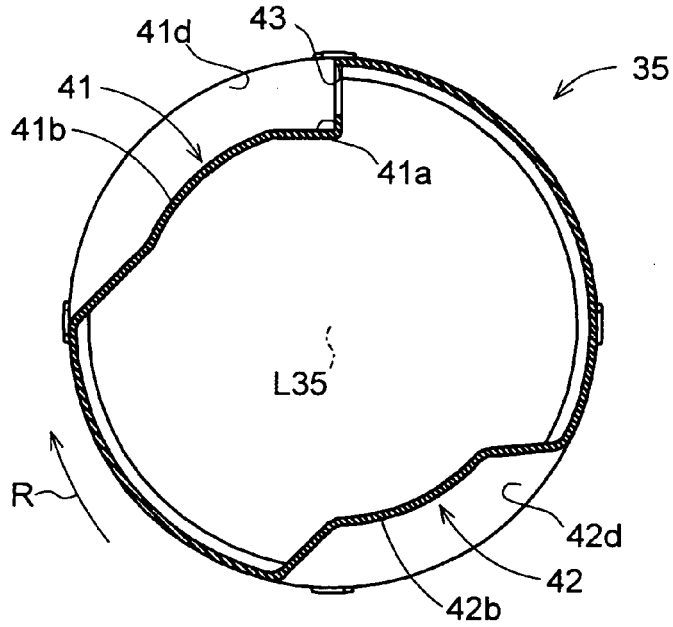
FIG. 10B is a sectional view taken on a line S102—S102 in FIG. 9.

FIG. 7 is a perspective view showing the third container segment 35, wherein the view is taken from the first concavity 41 side. FIG. 8 is a perspective view showing the third container segment 35, wherein the view is taken from the second concavity 42 side. FIG. 9 is an enlarged front view showing the third container segment 35. FIG. 10A is a sectional view taken on a line S101—S101 in FIG. 9. FIG. 10B is a sectional view taken on a line S102—S102 in FIG. 9. FIG. 4 is also referred for the explanation of the third container segment 35. The third container segment 35 is approximately formed into a cylindrical shape. The third container segment 35 will be explained in more detail as follows. In the middle portion in the axial direction of the outer circumferential portion, the first concavity 41 and the second concavity 42, which are concavities sinking inward in the radial direction, are provided. In the first concavity 41, the discharge hole 43 for discharging the developer is provided. For example, the length A35 in the axial direction of the third container segment 35 may be 80 mm. The inner diameter D35 of the third container segment 35 except for the first concavity 41 and the second concavity 42 is larger than the inner diameters D33 and D34 of the first, container segment 33 and the second container segment 34. The inner diameter D35 of the third container segment 35 except for the first concavity 41 and the second concavity 42 can be set at an arbitrary value, for example, the inner diameter D35 of the third container segment 35 may be set at 110 mm.

The first concavity 41 is formed being extended in the rotation direction R. The size W41 in the axial direction of the first concavity 41 is smaller than the size A41 in the rotation direction R. The first concavity 41 is provided with an end wall portion 41*a*, which crosses the rotation direction R, at the end portion on the downstream side in the rotation direction R. The discharge hole 43 is formed in a portion of the end wall portion 41*a* arranged on the downstream side in the rotation direction of the first concavity 41. The second concavity 42 is formed being extended in the rotation direction R. The size W42 in the axial direction of the second concavity 42 is smaller than the size A42 in the rotation direction R. The second concavity 42 is provided being distant from the first concavity 41 in the circumferential direction of the third container segment 35. It is preferable that the size A41 in the rotation direction R of the first concavity 41 is not less than ¼ and smaller than ½ of the outer circumferential length of the third container segment 35 except for the first concavity 41 and the second concavity 42. For example, the size A41 in the rotation direction R of the first concavity 41 may be 120 mm. For example, the size W41 in the axial direction may be 30 mm. The size A42 in the rotation direction R of the second concavity 42 may be set at an arbitrary value. For example, the size A42 in the rotation direction R of the second concavity 42 may be set at 120 mm. The size W42 in the axial direction may be set at an arbitrary value. For example, the size W42 in the axial direction may be set at 30 mm.

The first concavity 41 will be described in more detail as follows. The first concavity 41 further includes: a bottom wall portion 41*b*; a first side wall portion 41*c*; and a second side wall portion 41*d*. The bottom wall portion 41*d* of the first concavity 41 extends in the rotation direction R. The downstream side end portion of the bottom wall portion 41*b* in the rotation direction R is communicated with the inward portion in the radial direction of the end wall portion 41*a*. The upstream side end portion of the bottom wall portion 41*b* in the rotation direction R is smoothly communicated with the outer circumferential portion of the third container segment 35 except for the first concavity 41 and the second concavity 42 between the first concavity 41 and the second concavity 42. The central portion in the rotation direction R between the downstream side end portion in the rotation direction R of the bottom wall portion 41*b* of the first concavity 41 and the upstream side end portion in the rotation direction R is arranged inward in the radial direction compared with the third container segment 35 except for the first concavity 41 and the second concavity 42. Briefly speaking, the central portion in the rotation direction R is formed into a partially cylindrical shape, the axis of which is the axis L35 of the third container segment 35. The radius of curvature of the outer circumferential portion of the central portion in the rotation direction R of the bottom wall portion 41*b* of the first concavity 41 can be set at an arbitrary value. For example, the radius of curvature of the outer circumferential portion may be set at 49 mm.

The first side wall portion 41*c* of the first concavity 41 is arranged on one end side in the axial direction of the first concavity 41 and extended in the rotation direction R. The downstream side end portion of the first side wall portion 41*c* in the rotation direction R is communicated with one end portion in the axial direction of the end wall portion 41*a*. The inward portion of the first side wall portion 41*c* in the radial direction is communicated with one end portion in the axial direction of the bottom wall portion 41*b*. The outward portion of the first side wall portion 41*c* in the radial direction is communicated with the outer circumferential portion of one end portion in the axial direction of the third container segment 35 except for the first concavity 41 and the second concavity 42. The second side wall portion 41*d* of the first concavity 41 is arranged on the other end side in the axial direction of the first concavity 41 and extended in the rotation direction R. The downstream side end portion of the second side wall portion 41*d* in the rotation direction R is communicated with the other end portion in the axial direction of the end wall portion 41*a*. The inward portion of the second side wall portion in the radial direction is communicated with the other end portion in the axial direction of the bottom wall portion 41*b*. The outward portion of the second side wall portion 41*d* in the radial direction is communicated with the outer circumferential portion of the other end portion in the axial direction of the third container segment 35 except for the first concavity 41 and the second concavity 42. The first side wall portion 41*c* and the second side wall portion 41*d* of the first concavity are provided being perpendicularly arranged at the bottom wall portion 41*b* outward in the radial direction. The bottom wall portion 41*b* and the first side wall portion 41*c* are substantially perpendicular to each other. The bottom wall portion 41*b* and the second side wall portion 41*d* are substantially perpendicular to each other.

The discharge hole 43 is located at an intermediate portion in the axial direction of the end wall portion 41*a* of the first concavity 41 and outward in the radial direction, wherein the discharge hole 43 is formed into a rectangle, the long side of which is set in the axial direction. Accordingly, in the end wall portion 41*a* of the first concavity 41, the discharge hole 43 is open at a position which is located outward in the radial direction with respect to the downstream side end portion in the rotation direction R of the bottom wall portion 41*b* of the first concavity 41 and which is located on the other end side in the axial direction with respect to the downstream side end portion in the rotation direction R of the first side wall portion 41*c* and which is located on the one end side in the axial direction with respect to the downstream side end portion in the rotation direction R of the second side wall portion 41*d*. To be in more detail, the face on the outside in the radial direction of the discharge hole 43 is smoothly communicated with the inner circumferential face of the third container segment 35 except for the first concavity 41 and the second concavity 42 on the downstream side in the rotation direction R of the first concavity 41.

The second concavity 42 will be described in detail as follows. The second concavity 42 further includes: a bottom wall portion 42*b*; a first side wall portion 42*c*; and a second side wall portion 42*d*. The bottom wall portion 42*b* of the second concavity 42 extends in the rotation direction R. The upstream side end portion of the bottom wall portion 42*b* in the rotation direction R and the downstream side end portion of the bottom wall portion 42*b* in the rotation direction R are smoothly communicated with the outer circumferential portion of the third container segment 35 except for the first concavity 41 and the second concavity 42 between the first concavity 41 and the second concavity 42. The central portion in the rotation direction R between the downstream side end portion in the rotation direction R of the bottom wall portion 42*b* of the second concavity 42 and the upstream side end portion in the rotation direction R is arranged inward in the radial direction compared with the third container segment 35 except for the first concavity 41 and the second concavity 42. Summarily, the central portion in the rotation direction R is formed into a partially cylindrical shape, the axis of which is the axis L35 of the third container segment 35. The radius of curvature of the outer circumferential portion of the central portion in the rotation direction R of the bottom wall portion 42*b* of the second concavity 42 can be set at an arbitrary value. For example, the radius of curvature of the outer circumferential portion may be set at 49 mm.

The first side wall portion 42*c* of the second concavity 42 is arranged on one end portion side in the axial direction of the second concavity 42 and extended in the axial direction R. The inward portion of the first side wall portion 42*c* in the radial direction is communicated with one end portion in the axial direction of the bottom wall portion 42*b*. The outward portion of the first side wall portion 42*c* in the radial direction is communicated with the outer circumferential portion of one end portion in the axial direction of the third container segment 35 except for the first concavity 41 and the second concavity 42. The second side wall portion 42*d* of the second concavity 42 is arranged on the other end side in the axial direction of the second concavity 42. The inward portion of the second side wall portion 42*d* in the radial direction is communicated with the other end portion in the axial direction of the bottom wall portion 42*b*. The outward portion of the second side wall portion 42*d* in the radial direction is communicated with the outer circumferential portion of the other end portion in the axial direction of the third container segment 35 except for the first concavity 41 and the second concavity 42. The first side wall portion 42*c* and the second side wall portion 42*d* of the second concavity are provided being perpendicularly arranged at the bottom wall portion 42*b* outward in the radial direction. The bottom wall portion 42*b* and the first side wall portion 42*c* are substantially perpendicular to each other, and the bottom wall portion 42*b* and the second side wall portion 42*d* are substantially perpendicular to each other.

The container main body 31 is composed being integrated into one body in such a manner that one end portion in the axial direction of the third container segment 35 and the opening end portion 33*b* of the first container segment 33 are connected to each other and that the other end portion in the axial direction of the third container segment 35 and the opening end portion 34*b* of the second container segment 34 are connected to each other. The container main body 31 may be manufactured by means of blow molding of synthetic resin such as polyethylene. In this way, the container main body 31 can be easily manufactured and the number of parts of the developer container 30 can be decreased.

The bottom portion 33*a* of the first container segment 33 becomes one end portion 33*a* in the axial direction of the container main body 31, and the bottom portion 34*a* of the second container segment 34 becomes the other end portion 34*a* in the axial direction of the container main body 31. As described above, when the first container segment 33, the second container segment 34 and the third container segment 35 are connected with each other so that the axes L33, L34 and L35 of the containers can be aligned on the same axis, the container main body 31 can be formed. In the above state, the third container segment 35 is arranged in the central portion in the axial direction except for both end portions 33*a*, 34*a* in the axial direction of the container main body 31. Accordingly, the first concavity 41, the second concavity 42 and the discharge hole 43 of the third container segment 35 are arranged in the intermediate portion in the axial direction except for both end portions 33*a*, 34*a* in the axial direction of the container main body 31. The axis L31 of the container main body 31 is comprised of the axis L33 of the first container segment 33, the axis L34 of the second container segment 34 and the axis L35 of the third container segment 35.

The container main body 31 further includes a container side guide portion 100. The container side guide portion 100 is arranged in the neighborhood of the second concavity 42 on one side and the other side in the axial direction of the outer circumferential portion of the third container segment 35 of the container main body 31. The container side guide portion 100 elastically comes into contact with the inner circumferential portion 48 of the supporting member 32. The container side guide portion 100 guides the developer, which is located between the outer circumferential portion of the third container segment 35 and the inner circumferential portion 48 of the supporting member 32 into the second concavity 42, by the rotation of the container main body 31. To be in more detail, the container side guide portion 100 includes: a first container side guide portion 101; a second container side guide portion 102; and an auxiliary container side guide portion 103. For example, the container side guide portion 100 is made of high polymer resin such as polyehthylene terephthalate (abbreviation: PET). For example, the thickness may be not less than 10 μm and not more than 200 μm.

The first container side guide portion 101 is provided on one end side in the axial direction of the second concavity 42 in such a manner that the first container side guide portion 101 extends from the neighborhood of the end wall portion 42*a* of the second concavity 42 to the upstream side end portion in the rotation direction of the second concavity 42 and protrudes outside in the radial direction and comes close to the second concavity 42 as it is directed to the upstream side in the rotation direction. The second container side guide portion 102 is provided on the other end side in the axial direction of the second concavity 42 in such a manner that the second container side guide portion 102 extends from the neighborhood of the end wall portion 42*a* of the second concavity 42 to the upstream side end portion in the rotation direction of the second concavity 42 and protrudes outside in the radial direction and comes close to the second concavity 42 as it is directed to the upstream side in the rotation direction. The auxiliary container side guide portion 103 is provided in the upstream side end portion in the rotation direction of the second concavity 42 in such a manner that the auxiliary container side guide portion 103 extends from the first side wall portion 42*c* to the second side wall portion 42*d* of the second concavity 42 and protrudes outward in the radial direction. The space, which faces the outer circumferential portions of the container side guide portion 100 and the third container segment 35 and also faces the inner circumferential portion 48 of the supporting member 32, is open onto the downstream side in the rotation direction.

Summarily, the container side guide portion 100 is formed into a sheet shape having flexibility and elasticity. To be in more detail, the first container side guide portion 101 and the second container side guide portion 102 include a plurality of guide pieces protruding outward in the radial direction. Each guide piece is formed into a sheet shape having flexibility and elasticity. For example, the guide pieces are bonded to the outer circumferential face of the third container segment 35 of the container main body 31 by adhesive or an adhesive double coated tape in such a manner that the guide pieces protrude outward in the radial direction. When the container side guide portion 100 are divided into a plurality of pieces and bonded as described above, the container side guide portion 100 can be easily provided in the outer circumferential portion of the third container segment 35.

Figure 11:
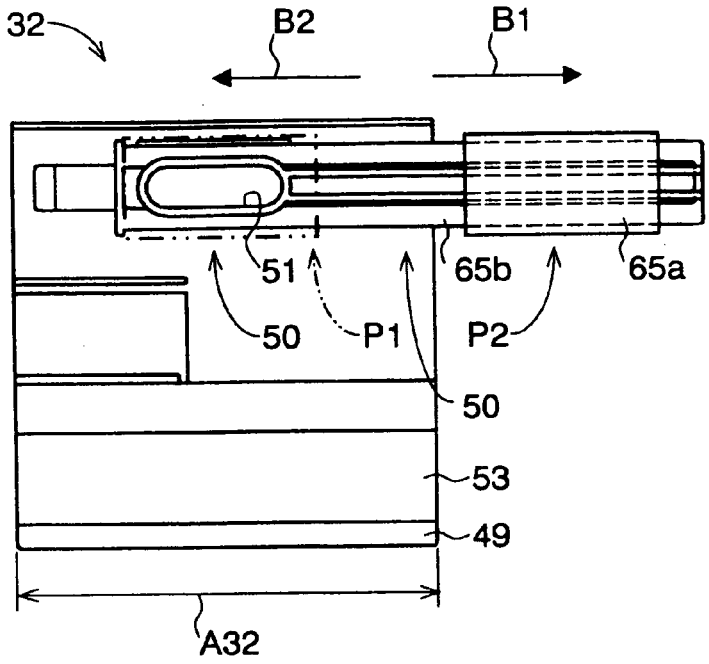
FIG. 11 is a front view showing a supporting member.
Figure 12:
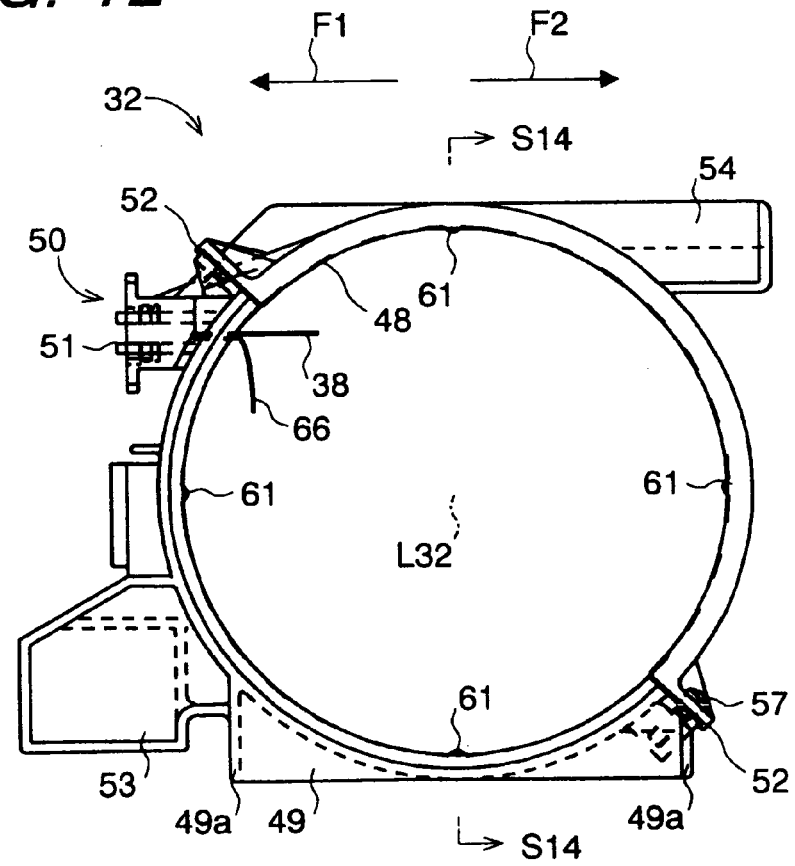
FIG. 12 is a right side view showing the supporting member.

FIG. 11 is a front view showing the supporting member 32. FIG. 12 is a right side view showing the supporting member 32. Summarily, the supporting member 32 is formed into a cylindrical shape and includes the inner circumferential portion 48 for supporting at least the third container segment 35 of the container main body 31, which is composed as described above, all over the circumference from the outside in the radial direction. The inner circumferential portion 48 includes a cylindrical inner circumferential face formed round the axis L32. The supporting member 32 includes a supporting base 49 having at least three or more abutment portions 49*a* on a virtual face parallel with the axis L32. The abutment portions 49*a* of the supporting base 49 may be formed into two rectangular planes, the longitudinal directions of which are parallel with the axis L32. When the abutment portions 49*a* of the supporting base 49 are made to come into contact with the horizontal face, the axis L48 of the inner circumferential portion 48 of the supporting member 32 can be arranged in parallel with the horizontal face. The length A32 in the axial direction of the supporting member 32 is set to be longer than the length A35 in the axial direction of the third container segment 35. The size A32 in the axial direction of the supporting member 32 can be set at an arbitrary value, for example, the size A32 in the axial direction of the supporting member 32 may be set at 100 mm.

Under the condition that the supporting base 49 is horizontally set, the discharge section 50, which protrudes in one first horizontal direction F1, is formed in an upper portion of the supporting member 32. In the middle portion in the axial direction of the supporting member 32 in the discharge section 50, the leading through hole 51 is provided which penetrates in the first horizontal direction and is formed into an elliptical shape extending in the direction parallel with the axis L32 of the supporting member. The inner diameter in the longitudinal direction of the leading through hole 51 is set at a value not less than the width W41 in the axial direction of the first concavity 41 of the container main body 31 and the width W42 in the axial direction of the second concavity 42.

In the discharge section 50 of the supporting member 32, the shutter portion 65 is provided which changes over the opening on the downstream side in the one first horizontal direction F1 of the leading through hole 51 between the open state and the closed state. The shutter portion 65 includes a shutter 65*a* and a shutter guide 65*b*. The shutter guide 65*b* extends in the second horizontal direction which is perpendicular to the first horizontal direction. The leading through hole 51 is open in the upstream side end portion in one second horizontal direction B1. The shutter 65*a* is slidably supported by the shutter guide 65*b* so that the shutter 65*a* can be freely displaced in the one second horizontal direction B1 and in the other second horizontal direction B2 which is opposite to the one second horizontal direction B1.

The shutter 65*a* is slidingly displaced along the shutter guide 65*b*, and is thereby arranged either in a closing position P1 as indicated by a chain double dashed line in FIG. 10 or in an opening position P2, at which the downstream side opening in the one first horizontal direction F1 of the leading through hole 51 is closed and opened. Moreover, the shutter 65*a* is restrained from further sliding displacement in the downstream side in the other second horizontal direction B2 beyond the closing position P1, and is also restrained from further sliding displacement in the one second horizontal direction B1 beyond the downstream side end in the one second horizontal direction B1 of the shutter guide 65*b*. That is, the opening position P2 is located in a position on the downstream side in the one second horizontal direction B1 as compared to the closing position P1, and is simultaneously located in a position on the upstream side in the one second horizontal direction B1 as compared to the downstream side end in the one second horizontal direction B1 of the shutter guide 65*b*. In this way, the shutter 65*a*, on the one hand, is shifted from the closing position P1 to the opening position P2 by being slidingly displaced in the one second horizontal direction B1, and on the other hand, is shifted from the opening position P2 to the closing position P1 by being slidingly displaced in the other second horizontal direction B2.

The supporting member 32 includes: a leading-out member 38 which is leading-out means; and a sealing sheet 66 which is a sealing means. The leading-out member 38 is made of high polymer resin such as polyethylene terephthalate (abbreviation: PET) and formed into a sheet shape having flexibility and elasticity. A proximal end portion of the leading-out member 38 is attached to the inner circumferential portion of the supporting member 32. To be in more detail, the leading-out member 38 is provided in a portion facing the upstream side end portion in the one first horizontal direction F1 of the leading through hole 51 of the supporting member 32. For example, the sealing sheet 66 is made of polyethylene and formed into a soft sheet shape. The proximal end portion of the sealing sheet 66 is attached to a portion facing the upstream side end portion in the one first horizontal direction F1 of the leading through hole 51 of the supporting member 32. The proximal end portion of the leading-out member 38 is laminated on an upper face of the proximal end portion of the sealing sheet 66. The leading-out member 38 and the sealing sheet 66 will be explained in more detail later.

In the supporting member 32, two coupling projections 52, which protrude outward in the radial direction, are formed. One coupling projection 52 is arranged in an upper portion of the discharge portion 50 under the condition that the supporting base 49 is horizontally installed. The other coupling projection 52 is arranged at a position symmetrical to the one coupling projection 52 described above with respect to the axis L32. The supporting member 32 includes a first guide piece 53 which is arranged in a portion lower than the discharge portion 50 under the condition that the supporting base 49 is horizontally set and which protrudes in the one first horizontal direction F1 and extends in parallel with the axis L32. Further, the supporting member 32 includes a second guide piece 54 which is arranged in an upper portion of the discharge portion 50 under the condition that the supporting base 49 is horizontally set and which protrudes in the other first horizontal direction F2, which is an opposite direction to the one first horizontal direction F1, and which extends in parallel with the axis L32.

Figure 13:
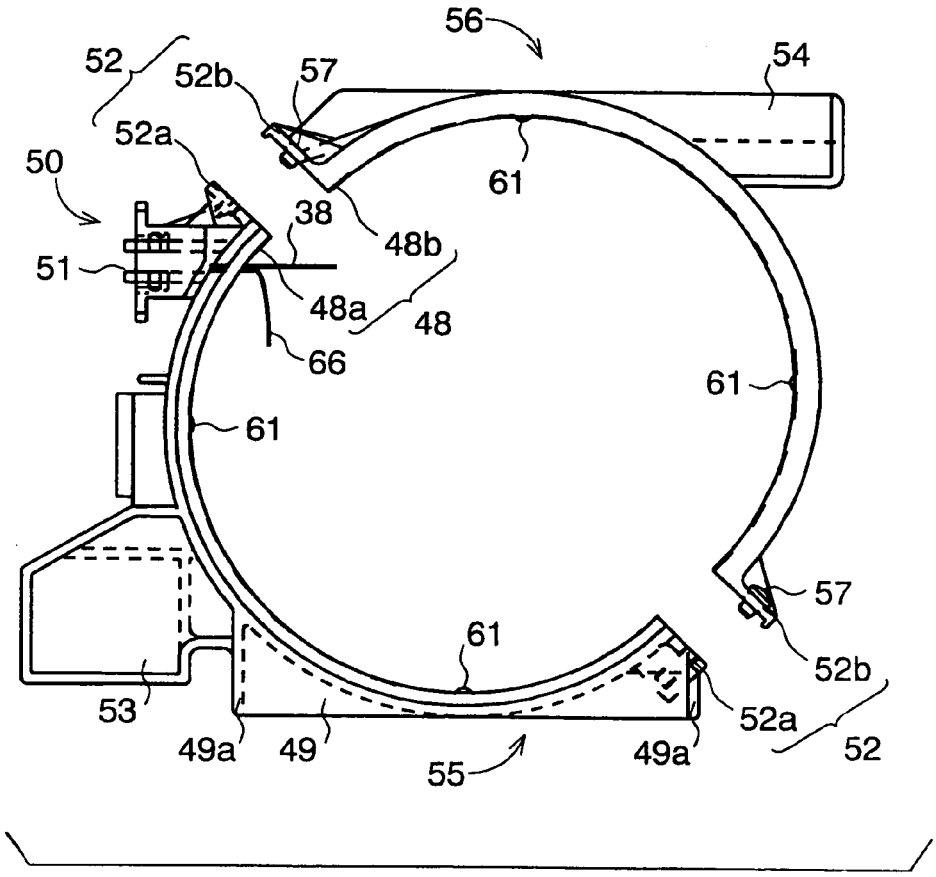
FIG. 13 is an exploded right side view showing the supporting member.

FIG. 13 is an exploded right side view showing the supporting member 32. The supporting member 32 can be divided into two pieces on a virtual plane which passes through the axis L32 and inclines upward as it is directed to the one first horizontal direction F1 under the condition that the supporting member is arranged on a horizontal plane. To be in more detail, the supporting member 32 can be divided into the first supporting portion 55, which is below the virtual plane, and the second supporting portion 56 which is above the virtual plane. The first supporting portion 55 of the supporting member 32 includes: the first guide piece 53; the discharge portion 50; one portion 52*a* of the coupling projection 52; the supporting base 49; and the portion 48*a* on the first guide piece 53 side of the inner circumferential portion 48. The second supporting portion 56 of the supporting member 32 includes: the second guide piece 54; the other portion 52*b* of the coupling projection 52; and the portion 48*a* on the supporting base 49 side of the inner circumferential portion 48.

The first supporting member 55 and the second supporting member 56 are detachably connected to each other by the screw members 57. To be in more detail, one portion 52*a* of the connecting coupling projection 52 of the first supporting portion 55 and the other portion 52*b* of the coupling projection 52 of the second supporting portion 56 are connected to each other by the screw members 57. Due to the foregoing, in the case where the container main body 31 is supported by the supporting member 32, the supporting member 32 is previously divided into the two pieces, and the divided supporting members 32 can support the container main body 31 all over the circumference when portions of the container main body 31 including the first 41 and the second concavity 42 and the discharge port 43 are supported from the outside in the radial direction. Therefore, the assembling work can be easily performed.

Figure 14:
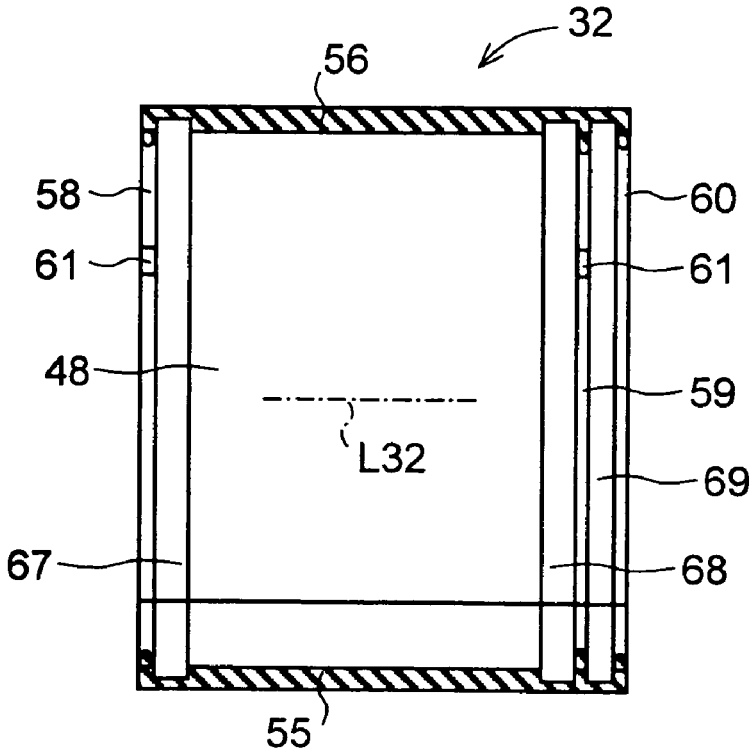
FIG. 14 is a sectional view taken on a line S14—S14 in FIG. 12.

FIG. 14 is a sectional view taken on a line S14—S14 in FIG. 12. Reference is also made into FIG. 12. In one end portion in the axial direction of the inner circumferential portion 48 of the supporting member 32, the first supporting convexity 58 is provided which extends all over the circumference in the circumferential direction and protrudes in the radial direction. In the other end portion in the axial direction of the inner circumferential portion 48 of the supporting member 32, the second supporting convexity 59 is provided which extends all over the circumference in the circumferential direction and protrudes inward in the radial direction. In the other end portion in the axial direction of the inner circumferential portion 48 of the supporting member 32, the third supporting convexity 60 is provided which extends all over the circumference in the circumferential direction and protrudes inward in the radial direction and which is provided on the other end portion side in the axial direction with respect to the second supporting convexity 59 at an interval between the second supporting convexity 59 and the third supporting convexity 60. The interval between the second supporting convexity 59 and the third supporting convexity 60 is set at a size a little larger than the size in the axial direction of the guide projection piece 40 of the second container segment 34 of the container main body 31. For example, the interval between the second supporting convexity 59 and the third supporting convexity 60 may be 3 mm.

In the first supporting convexity 58 and the second supporting convexity 59, a plurality of supporting projection pieces 61, which are arranged in the circumferential direction at regular intervals and protruded inward in the radial direction, are respectively formed. In the embodiment, four supporting projection pieces 61 are formed. A forward end portion inward in the radial direction of the supporting projection piece 61 has a supporting face curved like a cylindrical outer circumferential face. Concerning the supporting projection pieces 61 of the first supporting convexity 58 and the second supporting convexity 59, the diameter of a virtual circle passing through the forward end portion of each guide projection piece 40 round the axis L32 is a little larger than the outer diameter of the outer circumferential portion of the first container segment 33 and the outer diameter of the outer circumferential portion of the second container segment 34 except for the guide projection pieces 40. For example, the diameter may be 107 mm. The inner diameter of the third supporting convexity 60 is set at a size a little larger than the outer diameter of the outer circumferential portion of the second container segment 34 except for the guide projection piece 40. For example, the inner diameter may be 107 mm.

There is provided a first supporting concavity 67 which is adjacent to the other end portion side in the axial direction of the first supporting convexity 58 in one end portion in the axial direction of the inner circumferential portion 48 of the supporting member 32 and sinks outward in the radial direction and extends all over the circumference in the circumferential direction. There is provided a second supporting concavity 68 which is adjacent to one end portion side in the axial direction of the second supporting convexity 59 in the other end portion in the axial direction of the inner circumferential portion 48 of the supporting member 32 and sinks in the radial direction and extends all over the circumference in the circumferential direction. There is provided a third supporting concavity 69 which is located between the second supporting convexity 59 of the other end portion in the axial direction of the inner circumferential portion 48 of the supporting member 32 and the third supporting convexity 60 and sinks in the radial direction and extends all over the circumference in the circumferential direction. For example, the sizes in the axial direction of the first supporting concavity 67 and the second supporting concavity 68 may be 7 mm. The size of the third supporting concavity 69 in the axial direction is set a little larger than the size in the axial direction of the guide projection piece 40 of the second container segment 34 of the container main body 31. For example, the size of the third supporting concavity 69 in the axial direction may be set at 3 mm.

Figure 15:
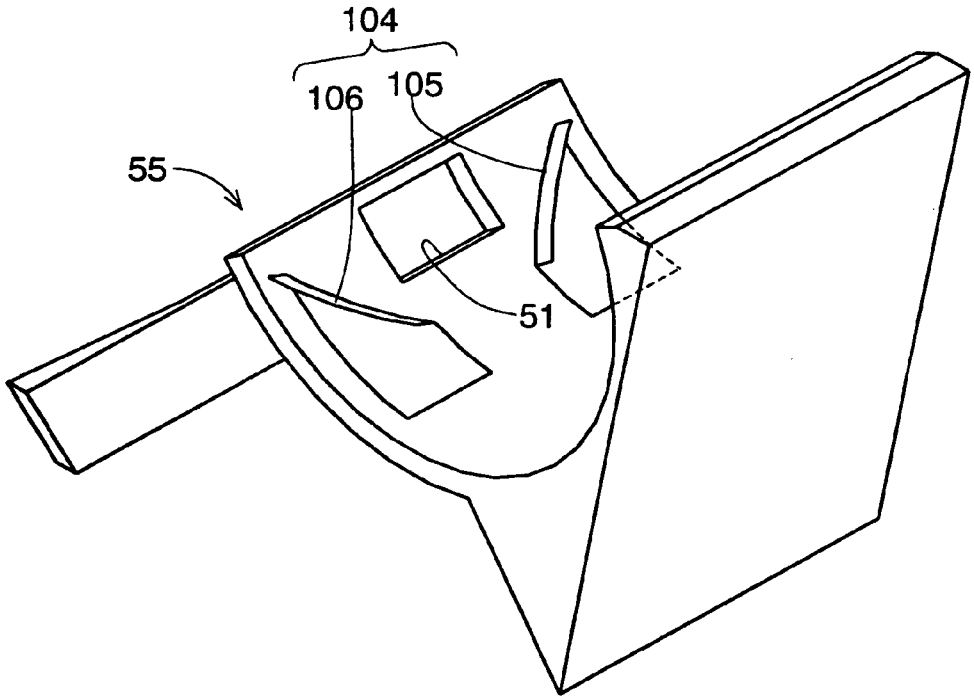
FIG. 15 is a perspective view of a first supporting portion, wherein the view is taken from the inner circumferential portion side.

FIG. 15 is a perspective view of the first supporting portion 55, wherein this view is taken from the inner circumferential portion 48 side. In the neighborhood of the leading through hole 51 of the inner circumferential portion 48 of the first supporting portion 55 of the supporting member 32, a supporting side guide portion 104 is provided. The supporting side guide portion 104 guides the developer between the outer circumferential portion of the container main body 31 and the inner circumferential portion 48 of the supporting member 32 into the leading through hole 51. To be in more detail, the supporting side guide portion 104 includes: the first supporting side guide portion 105 arranged on one side in the direction of the axis L32 of the leading through hole 51; and the second supporting side guide portion 106 arranged on the other side in the direction of the axis L32 of the leading through hole 51. The first 105 and the second supporting side guide portion 106 are formed into a sheet-shape having flexibility and elasticity and protrude inward in the radial direction, and free end portions elastically come into contact with the outer circumferential portion of the third container segment 35 of the container main body 31. The supporting side guide portion 104 is made of high polymer resin such as polyehthylene terephthalate (abbreviated as PET). For example, the thickness may be not less than 10 μm and not more than 200 μm.

The first 105 and the second supporting side guide portion 106 extend from the rotation direction upstream side end portion of the peripheral edge portion of the leading through hole 51 to the downstream side end portion and come close to each other as the first 105 and the second supporting side guide portion 106 are directed toward the downstream side in the rotation direction. For example, the first 105 and the second supporting side guide portion 106 may be joined to the first supporting portion 55 by adhesive.

Figure 16A:
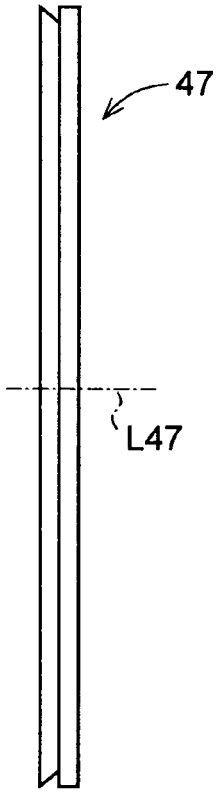
FIG. 16A is a front view showing a sealing material.
Figure 16B:
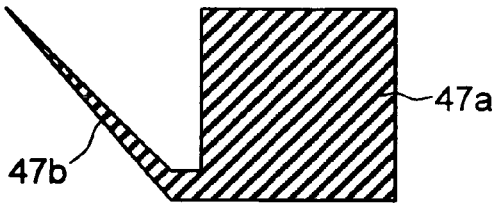
FIG. 16B is a view showing a section perpendicular to the circumferential direction of the sealing material.

FIG. 16A is a front view showing a sealing material 47. FIG. 16B is a sectional view showing a section perpendicular to the circumferential direction of the sealing material 47. The sealing material 47, which is sealing means, is flexible and elastic and made of synthetic resin such as silicon rubber. As shown in FIG. 16A, the sealing material 47 is formed into a substantially annular shape. As shown in FIG. 16B, the sealing material 47 includes: a base portion 47*a*; and a contact portion 47*b*. A cross section of the base portion 47*a* of the sealing material 47, which is perpendicular to the circumferential direction round the axis L35, is formed into a rectangular shape. The contact portion 47*b* of the sealing material 47 is one end portion in the axial direction of the base portion 47*a*. The contact portion 47*b* of the sealing material 47 protrudes being inclined outward in the radial direction from the inward portion in the radial direction as it is directed from the other end portion in the axial direction to one end portion in the axial direction.

The diameter of the inner circumferential portion of the base portion 47*a* of the sealing material 47 is set smaller than the outer diameter of the outer circumferential portion of the first container segment 33 of the container main body 31 and the outer diameter of the outer circumferential portion of the second container segment 34 except for the guide projection pieces 40. For example, the diameter of the inner circumferential portion of the base portion 47*a* of the sealing material 47 may be set at 99 mm. The diameters of the outer circumferential portions of the base portion 47*a* and the contact portion 47*b* of the sealing material 47 are set to be the same as or larger than the diameter of a virtual circle passing through the outer circumferential portion of the discharge guide piece 44 of the third container segment 35 of the container main body 31 round the rotation axis L31. For example, the diameters of the outer circumferential portions of the base portion 47*a* and the contact portion 47*b* of the sealing material 47 may be 115 mm. The size in the axial direction of the sealing material 47 is set to be not more than the sizes in the axial direction of the first 67 and the second supporting concavity 68 of the supporting member 32. For example, the size in the axial direction of the sealing material 47 may be set at 6 mm.

Figure 17:
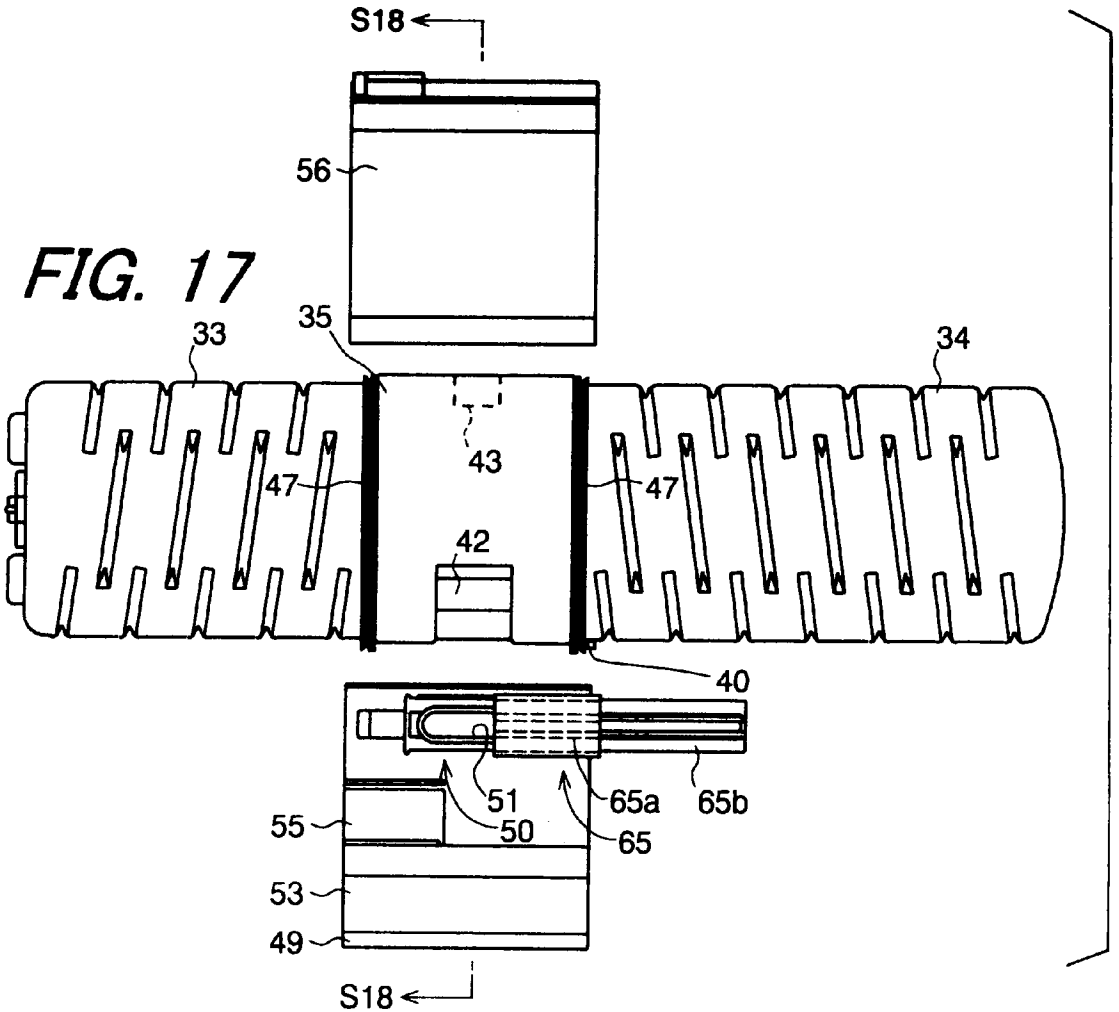
FIG. 17 is a front view showing a state of assembling the developer container.
Figure 18:
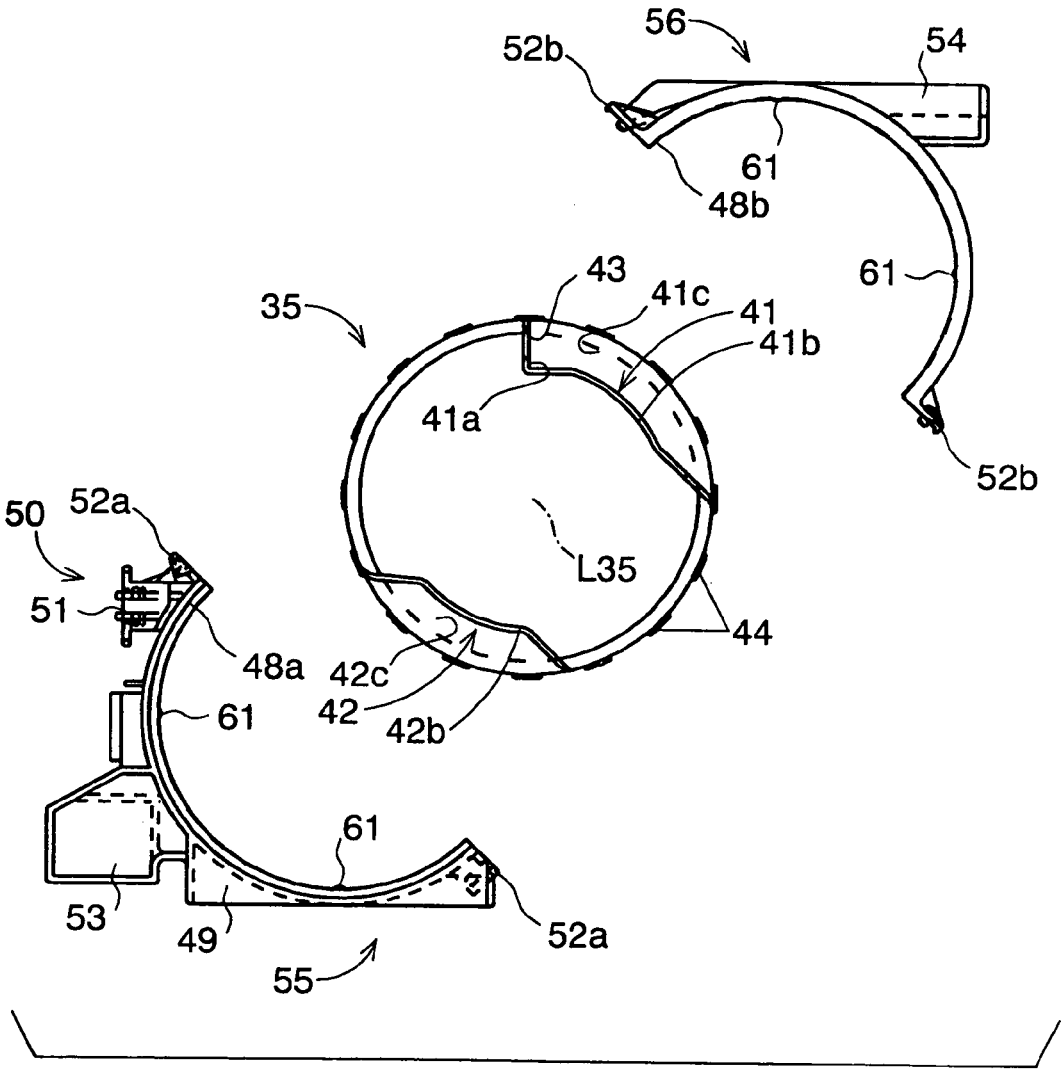
FIG. 18 is a sectional view taken on a line S18—S18 in FIG. 17.

FIG. 17 is a front view showing a state in which the developer container 30 is assembled. FIG. 18 is a sectional view taken on a line S18—S18 in FIG. 17. Before the developer container 30 is assembled, the supporting member 32 is divided into the first supporting portion 55 and the second supporting portion 56. At this time, one of the two sealing materials 47 is closely wound round the opening end portion 33*b* of the first container segment 33, and the base portion 47*a* of the sealing material 47 is closely contacted with an end face of one end portion in the axial direction of the third container segment 35. In this way, the sealing material 47 is attached to the first container segment 33 of the container main body 31. The other sealing material 47 is closely wound round the opening end portion 34*b* of the second container segment 34 one end portion side in the axial direction with respect to the guide projection piece 40, and further the base portion 47*a* of the sealing material 47 is closely contacted with an end face of the other end portion in the axial direction of the third container segment 35. In this way, the other sealing material 47 is attached to the second container segment 34 of the container main body 31.

A portion of the container main body 31 including the third container segment 35 is held by the first supporting portion 55 and the second supporting portion 56 so that the portion of the container main body 31 can be interposed from the outside in the radial direction. In this condition, the first supporting portion 55 and the second supporting portion 56 are connected to each other by the screw member 57.

Figure 19:
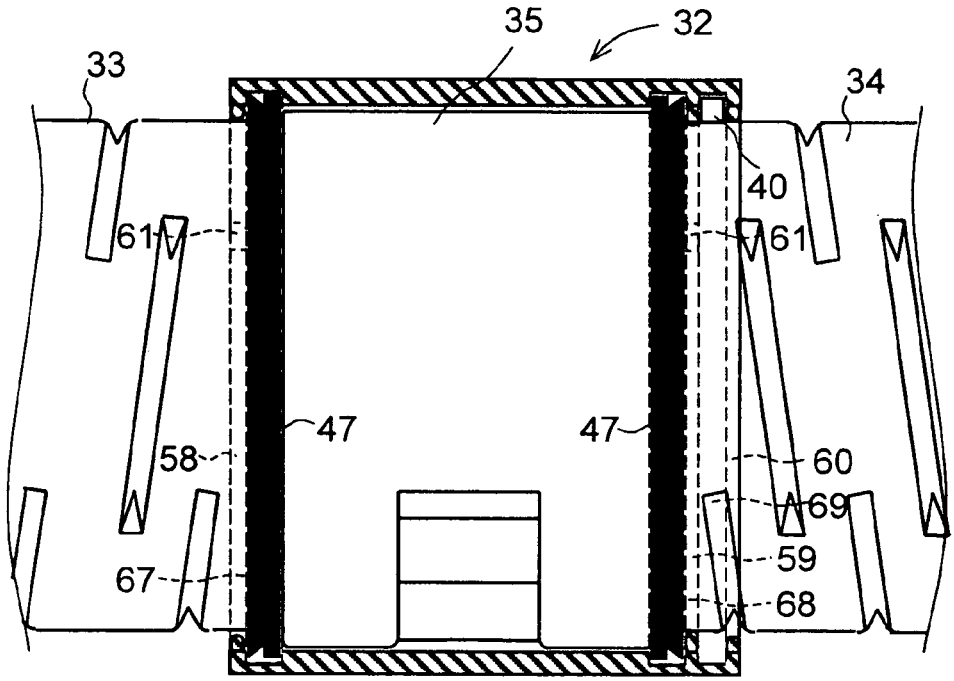
FIG. 19 is a sectional view taken on a line S19—S19 in FIG. 3.

FIG. 19 is a sectional view taken on a line S19—S19 in FIG. 3. Under the condition that the container main body 31 is supported by the supporting member 32, the axial line L31 of the container main body 31 and the axial line L32 of the inner circumferential portion 48 of the supporting member 32 are completely or substantially agree with each other. In this case, the container main body 31 can be freely rotated round the axis L31 with respect to the supporting member 32. In the case where the supporting base 49 of the supporting member 32 is installed on a horizontal face in the above condition, the first 33 and the second container segment 34 of the container main body 31 are separate from the horizontal face, and the rotation axis L31 and the horizontal face become parallel with each other.

The supporting member 32 will be described in more detail as follows. Each supporting projection piece 61 of the first supporting convexity 58 comes into contact with the outer circumferential portion of the first container segment 33, and each supporting projection piece 61 of the second supporting convexity 59 comes into contact with the outer circumferential portion of the second container segment 34 except for the guide projection piece 40. As described above, the outer circumferential portion of the first container segment 33 is substantially supported at four points by each supporting projection piece 61 of the first supporting convexity 58 at regular intervals in the circumferential direction and substantially supported at four points by each supporting projection piece 61 of the second supporting convexity 59 at regular intervals in the circumferential direction. Due to the foregoing, a frictional force resisting the rotation of the container main body 31 can be greatly reduced between the outer circumferential portion of the first container segment 33 and the first supporting convexity 58 and between the outer circumferential portion of the second container segment 34 and the second supporting convexity 59.

The sealing material 47 of the first container segment 33 is engaged in the first supporting concavity 67 of the supporting member 32, and the contacting portion 47*b* of the sealing material 47 elastically comes into contact with the other end face in the axial direction of the first supporting convexity 58 all over the circumference. The sealing material 47 of the second container segment 34 is engaged in the second supporting concavity 68 of the supporting member 32, and the contacting portion 47*b* of the sealing material 47 elastically comes into contact with one end face in the axial direction of the second supporting convexity 59 all over the circumference. By the two sealing materials 47 described above, sealing can be accomplished in the first 41 and the second concavity 42 of the container main body 31 and the discharge hole 43. Sealing can be also accomplished between the container main body 31 and the supporting member 32 on one end side in the axial direction of the container main body 31 and on the other end side in the axial direction with respect to the leading through hole 51 of the supporting member 32 all over the circumference in the circumferential direction.

The guide projection piece 40 of the second container segment 34 of the container main body 31 is engaged in the third supporting concavity 69 of the supporting member 32 so that the guide projection piece 40 can not be displaced being slid in the axial direction with respect to the supporting member 32. Due to the foregoing, a sliding displacement of the container main body 31 in the axial direction with respect to the supporting member 32 can be regulated. The outer circumferential portion of each discharge guide piece 44 of the third container segment 35 of the container main body 31 comes into contact with the inner circumferential portion 48 of the supporting member 32. In this way, the supporting member 32 pivotally supports a portion of the container main body 31 including at least the first concavity 41 from the outside in the radial direction all over the circumference so that the container main body 31 can be freely rotated.

Figure 20:
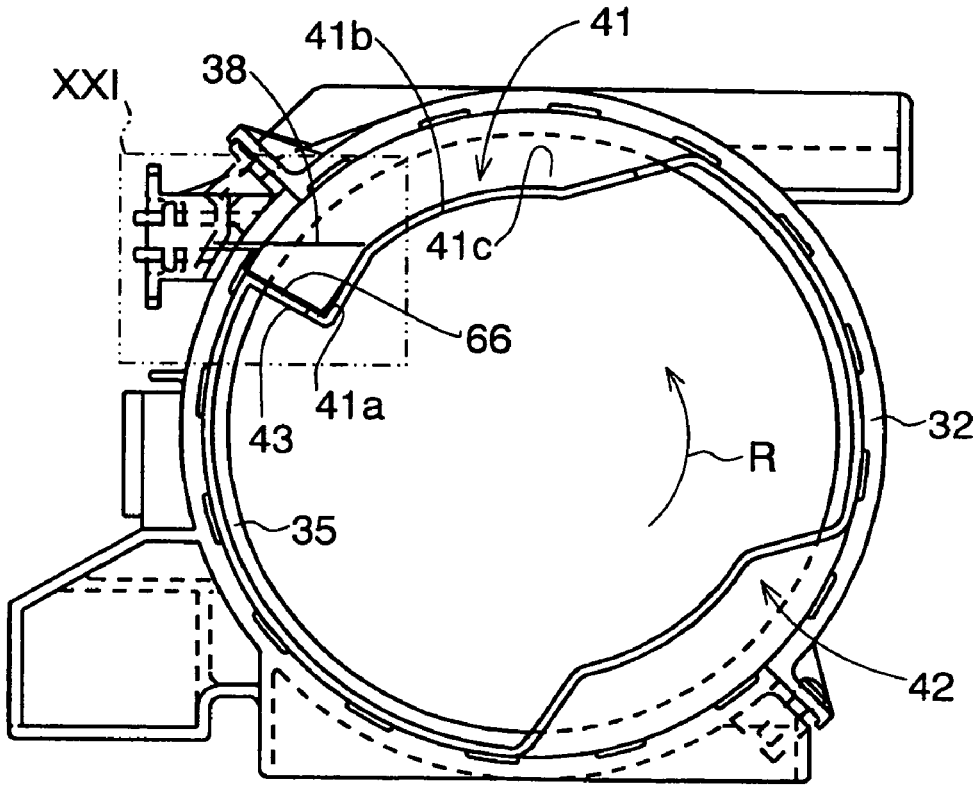
FIG. 20 is a sectional view taken on a line S20—S20 in FIG. 2.
Figure 21A:
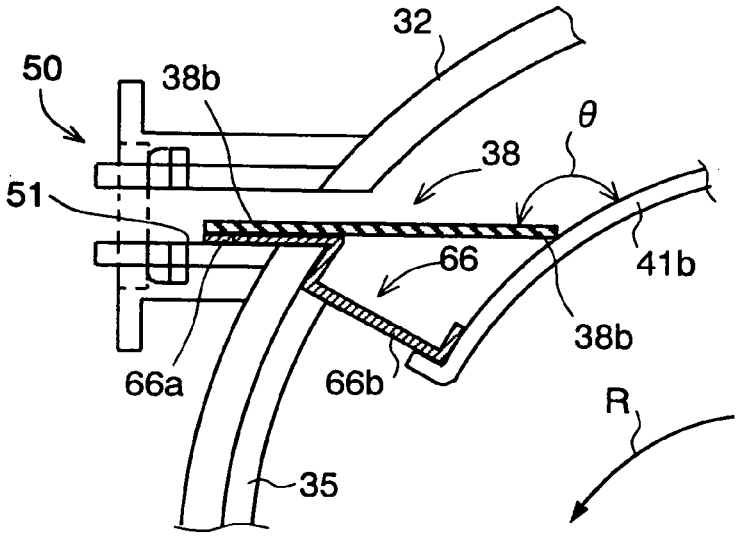
FIGS. 21A and 21B are enlarged views showing section XXI in FIG. 20.
Figure 21B:
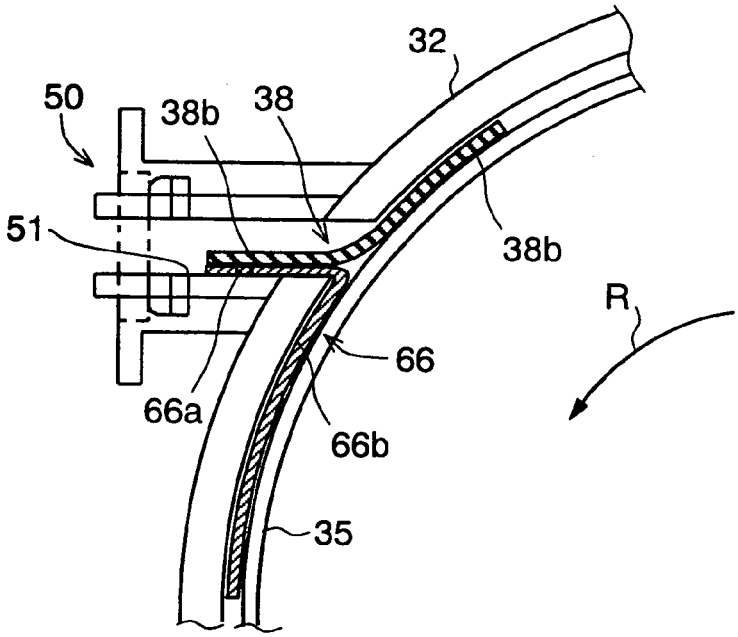

FIG. 20 is a sectional view taken on a line S20—S20 in FIG. 2. FIGS. 21A and 21B are enlarged views showing section XXI in FIG. 20. FIGS. 20 and 21A are views showing the container main body 31 which is in the initial stage with respect to the supporting member 32. The leading-out member 38 is arranged in such a manner that the proximal end portion 38*a* is set in a portion facing the upstream side end portion in the one first horizontal direction F1 of the leading through hole 51 of the supporting member 32, and the leading-out member 38 extends onto the upstream side in the rotation direction R. In this case, the free end portion 38*b* can be elastically contacted with at least the bottom wall portion 41*b* of the first concavity 41 of the third container segment 35 of the container main body 31 and further the free end portion 38*b* can be elastically contacted with the outer circumferential face of the bottom wall portion 42*b* of the second concavity 42. The free end portion 38*b* of the leading portion 38 comes into contact with the outer circumferential faces of at least the bottom wall portion 41*b* of the first concavity 41 of the third container segment 35 of the container main body 31 and the bottom wall portion 42*b* of the second concavity 42 in such a manner that an angle θexceeding 90° is formed between the free end portion 38*b* and the outer circumferential faces. To be in more detail, the angle θis defined as an angle formed between the upper face of the free end portion 38*b* of the leading-out member 38 and the outer circumferential faces of the bottom wall portions 41*b*, 42*b* of the concavities 41, 42.

The sealing sheet 66 is provided in a portion of the proximal end portion 66*a* facing the upstream side end portion in the one first horizontal direction F1 of the leading through hole 51 of the supporting member 32. A portion 66*b* of the sealing sheet 66 except for the proximal end portion 66*a* is detachably provided by means of thermal welding so that the portion 66*b* of the sealing sheet 66 can cover at least the end wall portion 41*a* of the first concavity 41 when the container main body 31 is in the initial stage with respect to the supporting member 32. In this initial stage, the discharge hole 43 is closed by the portion 66*b* except for the proximal end portion 66*a* of the sealing sheet 66. Due to the foregoing, even when a user mistakenly arranges the shutter 65*a* of the shutter portion 65 at the opening position P2 in the initial stage, the developer accommodated in the container main body 31 can be prevented from undesirably discharged from the leading through hole 51.

When the container main body 31 in the initial stage is rotated round the rotation axis L31 in the rotation direction R, the portion 66*b* except for the proximal end portion 66*a* of the sealing sheet 66 is separated from the end wall portion 41*a* of the first concavity 41, and the discharge hole 43 can be opened. The portion 66*b* of the sealing sheet 66 except for the proximal end portion 66*a*, which has been separated from the end wall portion 41*a* of the first concavity 41, is arranged between the third container segment 35 of the container main body 31 and the inner circumferential portion 48 of the supporting member 32 on the downstream side in the rotation direction R with respect to the leading through hole 51 of the supporting member 32 as shown in FIG. 21B. Due to the foregoing, the discharge hole 43 can be easily opened by rotating the container main body 31 even when the user does not directly remove the sealing sheet 66.

When the supporting base 49 of the supporting member 32 is installed on a horizontal plane and the developer is accommodated in the container, two layers, which include the developer layer containing the developer and the gas layer containing gas located above the developer layer, are formed in the inner space of the container main body 31. The container main body 31 is rotated counterclockwise round the rotation axis L31 when the second container segment 34 is viewed from the first container segment 33. At this time, the developer on the developer layer in the first container segment 33 is conveyed in the first conveying direction C1 (shown in FIG. 2), which is directed from the first container segment 33 to the third container segment 35, along the rotation axis L31 by the first projection pieces 36. At this time, the developer on the developer layer in the second container segment 34 is conveyed in the second conveying direction C2 (shown in FIG. 2), which is directed from the second container segment 34 to the third container segment 35, along the rotation axis L31 by the second projection pieces 39. When the container main body 31 is rotated round the rotation axis L31, the accommodated developer can be conveyed toward the discharge hole 43. Further, in the third container segment 35, the developer conveyed in the first conveying direction C1 and the developer conveyed in the second conveying direction C2 collide with each other. Due to the foregoing, the developer can be agitated.

While the developer is being conveyed, the developer is given a force which is directed from the inner circumferential portions of the first 33 and the second container segment 34 including the first 36 and the second projection pieces 39 to the third container segment 35. In the case where a large quantity of developer is accommodated in the container main body 31, the developer arranged in a range from the inner circumferential portions of the first 33 and the second container segment 34 to the protruding height A2 of the first 36 and the second projection pieces 39 inward in the radial direction is mainly agitated when the container main body 31 is rotated. Therefore, the developer is well balanced in the container main body 31.

FIGS. 22A, 22B, 23A and 23B are views for explaining the operation in which the developer in the third container segment 35 of the container main body 31 is guided to the leading through hole 51 of the supporting member 32 when the container main body 31 is rotated in the rotation direction R round the rotation axis L31. In the explanations, FIGS. 7, 9 and 19 are also referred. Under the condition that the container main body 31 is supported by the supporting member 32 so that the container main body 31 can be freely rotated round the rotation axis L31, the first retaining space 62*a* is formed which faces the first concavity 41 of the third container segment 35 and the inner circumferential portion 48 of the supporting member 32. The first retaining space 62*a* is substantially a closed space except for the discharge hole 43 and arranged on the upstream side in the rotation direction R of the discharge hole 43. The first retaining space 62*a* is communicated with a space 64 in the container main body 31 via the discharge hole 43. The second retaining space 62*b* is formed which faces the second concavity 42 of the third container segment 35 and the inner circumferential portion 48 of the supporting member 32. The second retaining space 62*b* is substantially a closed space.

Figure 22A:
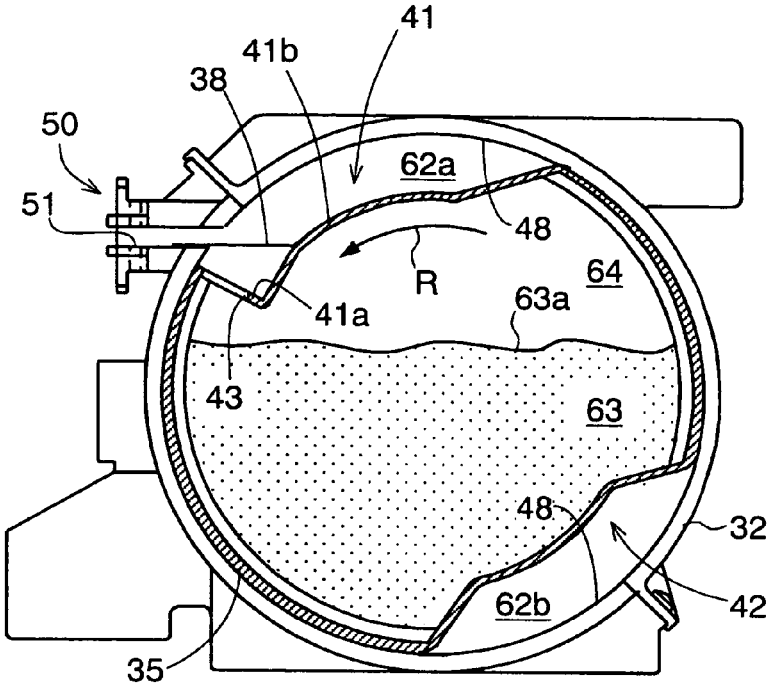
FIGS. 22A and 22B are views for explaining actions in which the developer in the third container segment of the container main body is guided into a leading through hole of the supporting member when the container main body is rotated round rotation axis in rotation direction R.
Figure 22B:
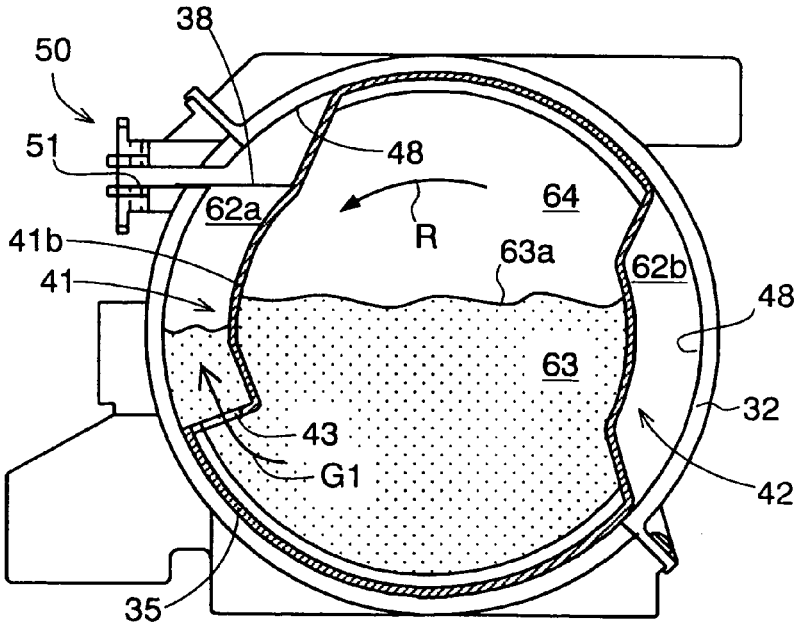

In the state shown in FIG. 22A in which the discharge hole 43 and the first retaining space 62*a* are arranged above the upper face 63*a* of the developer layer 63 in the container main body 31, the container main body 31 is rotated in the rotation direction R, and the discharge hole 43 and the downstream portion in the rotation direction R of the first retaining space 62*a* comes below the upper face 63*a* of the developer layer 63 in the container main body 31 as shown in FIG. 22B. Then, the developer on the developing layer 63 in the container 31 flows into the downstream portion in the rotation direction R of the first retaining space 62*a* via the discharge hole 43 as shown by arrow G1.

As described before, the discharge hole 43 is formed into an opening of a rectangular shape, the longitudinal direction of which is the axial direction, in the middle portion in the axial direction of the end wall portion 41*a* of the first concavity 41 outward in the radial direction. Accordingly, in the end wall portion 41*a* of the first concavity 41, the discharge hole 43 is arranged to be open outward in the radial direction with respect to the downstream end portion in the rotation direction R of the bottom wall portion 41*b* of the first concavity 41 and on the other end portion in the axial direction with respect to the downstream side end portion in the rotation direction R of the first side wall portion 41*c* and on one end side in the axial direction with respect to the downstream side end portion in the rotation direction R of the second side wall portion 41*d*.

For example, in the case where the discharge hole 43 is open in the entire end wall portion 41*a*, the developer is densely pushed out along the first concavity 41 of the container main body 31 and the inner circumferential portion 48 of the supporting member 32 when the container main body 31 is rotated in the rotation direction R. In this way, the developer is discharged from the discharge hole 43 into the first retaining space 62*a*. When the container main body 31 is further rotated in the rotation direction R in the above condition, there is a possibility that the developer held in the first retaining space 62*a* is coagulated being pushed by the first concavity 41 of the container main body 31 and the inner circumferential portion 48 of the supporting member 32. In the embodiment, as described before, the discharge hole 43 is formed in a portion of the side wall portion 41*a* of the first concavity 41. In other words, an opening area of the discharge hole 43 is formed to be smaller than the area of the end wall portion 41*a*. Therefore, the developer is discharged into the first retaining space 62*a* being diffused in the neighborhood of the discharge hole 43 in the first retaining space 62*a*. Due to the foregoing, the developer discharged into the first retaining space 62*b* can be made into powder. Accordingly, the occurrence of coagulation of the developer, which is caused by the rotation of the container main body 31 as described before, can be prevented.

Further, a face on the outside in the radial direction of the discharge hole 43 is smoothly communicated with the inner circumferential face of the third container segment 35 at the downstream side of the rotation direction R of the first concavity 41 except for the first concavity 41 and the second concavity 42. Due to the foregoing, even when a quantity of the developer accommodated in the container main body 31 is very small, the developer can easily flow into the downstream portion in the rotation direction R of the first retaining space 62*a* via the discharge hole 43.

Figure 23A:
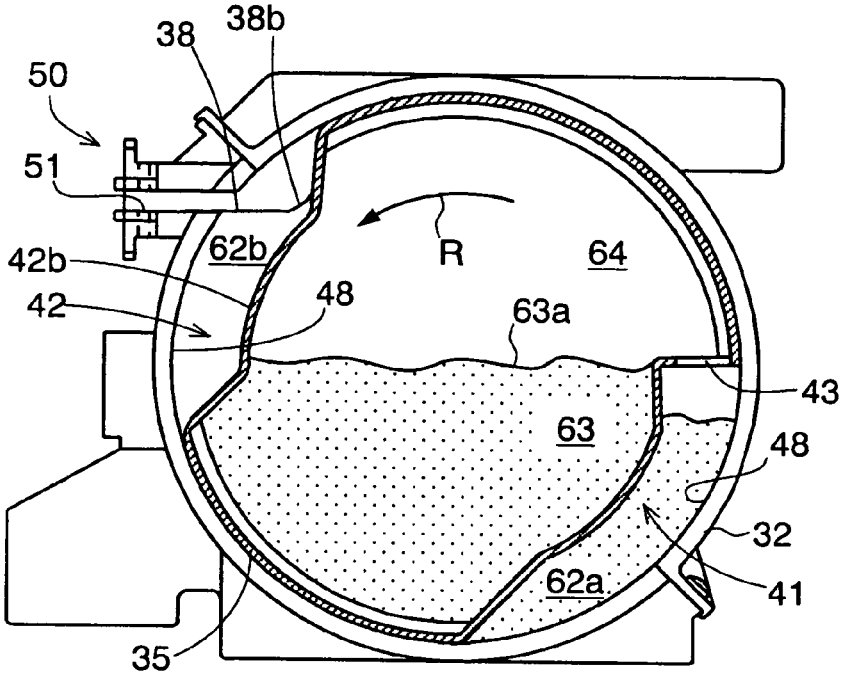
FIGS. 23A and 23B are views for explaining actions in which the developer in the third container segment of the container main body is guided into the leading through hole of the supporting member when the container main body is rotated round rotation axis in rotation direction R.

When the container main body 31 is further rotated in the rotation direction R in the state shown in FIG. 22B, the developer on the developer layer 63 in the container main body 31 flows into the downstream portion in the rotation direction R of the first retaining space 62*a* via the discharge hole 43, and the discharge hole 43 shown in FIG. 23A is arranged in an upper portion with respect to the upper face 63*a* of the developer layer 63 in the container main body 31, and the first retaining space 62*a* is arranged in a lower portion with respect to the upper face 63*a* of the developer layer 63 in the container main body 31. In the state shown in FIG. 23A, a predetermined quantity of the developer is held in the first retaining space 62*a*. For example, the quantity of the developer held in the first retaining space 62*a* may be 6 g.

Figure 23B:
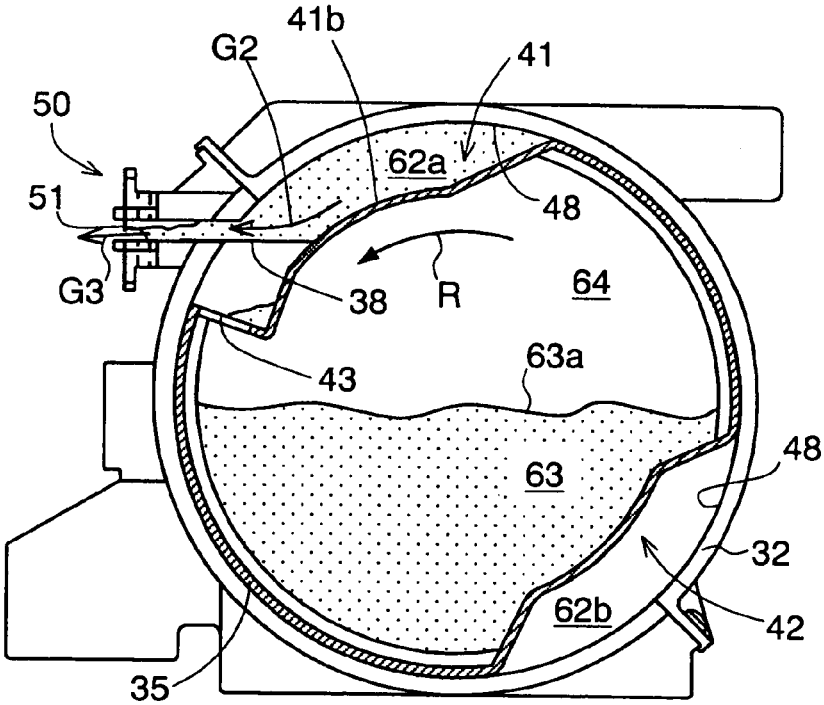

When the container main body 31 is further rotated in the rotation direction R in the state shown in FIG. 23A, as shown in FIG. 23B, the free end portion 38*b* of the leading-out member 38 of the supporting member 32 proceeds into the first retaining space 62*a* and extends onto the upstream side of the rotation direction R. Therefore, while the free end portion 38*b* of the leading-out member 38 is elastically coming into contact with the outer circumferential face of the bottom wall portion 41*b* of the first concavity 41 by an angle θexceeding 90°, the free end portion 38*b* of the leading-out member 38 slides on the outer circumferential face concerned. At this time, the developer held in the first retaining space 62*a* on the upstream side in the rotation direction R with respect to the leading-out member 38 flows toward the supporting member 32 when the container main body 31 is rotated in the rotation direction R.

As shown by arrow G2 in the drawing, the leading-out member 38 guides the developer, which is flowing in this way, to the leading through hole 51 along the upper face of the leading-out member 38. In other words, the leading-out member 38 guides the developer, which has been discharged from the discharge hole 43 of the container main body 31, to the leading through hole 51 along the upper face of the leading-out member 38. Since the leading-out member 38 slides on the outer circumferential face concerned while the leading-out member 38 is scraping off the developer from the outer circumferential face of the bottom wall portion 41*b* of the first concavity 41, all the developer held in the first retaining space 62*a* can be guided into the leading through hole 51. The developer guided into the leading through hole 51 in this way is sent outside the developer container 30 and discharged. Each time the container main body 31 is rotated in the rotation direction R round the rotation axis L31 by one revolution as described above, the predetermined quantity of the developer described before can be discharged outside.

The portion of the third container segment 35 except for the first 41 and the second concavity 42 is not entirely contacted with the inner circumferential portion 48 of the supporting member 32 all over the circumference in the circumferential direction as described above so that a frictional force to block the rotation of the container main body 31 round the rotation axis L31 can be reduced. Accordingly, there is a possibility that the developer held in the first retaining space 62*a* leaks out from the first retaining space 62*a*. As described above, the discharge guide pieces 44 are provided in the outer circumferential portions of one end portion and the other end portion in the axial direction except for the first concavity 41 and the second concavity 42 of the third container segment 35. The discharge guide piece 44 provided in one end portion in the axial direction of the third container segment 35 is inclined in the rotation direction R as it comes to one end portion in the axial direction from the other end portion in the axial direction. The discharge guide piece 44 provided in the other end portion in the axial direction of the third container segment 35 is inclined in the rotation direction R as it comes to the other end portion in the axial direction from one end portion in the axial direction. Accordingly, even when the developer held in the first retaining space 62*a* leaks out to one side and the other side in the direction of the rotation axis L32, the developer can be collected to an intermediate portion in the axial direction of the third container segment 35 and the supporting member 32 by the discharge guide pieces 44 when the container main body 31 is rotated in the rotation direction R.

As described before, the second retaining space 62*b* is formed. Accordingly, even when the developer held in the first retaining space 62*a* leaks out from the upstream portion in the rotation direction R of the first retaining space 62*a*, the developer, which has leaked out in this way, and the developer, which has been collected to the intermediate portion in the axial direction by the discharge guide pieces 44, are held by the second retaining space 62*b*. When the container main body 31 is rotated in the rotation direction R, as shown in FIG. 23A, the free end portion 38*b* of the leading-out member 38 of the supporting member 32 proceeds into the second retaining space 62*b* and extends onto the upstream side of the rotation direction R. Therefore, while the free end portion 38*b* of the leading-out member 38 is elastically coming into contact with the outer circumferential face of the bottom wall portion 42*b* of the second concavity 42 by an angle θexceeding 90°, the free end portion 38*b* of the leading-out member 38 slides on the outer circumferential face concerned. At this time, the developer held in the second retaining space 62*b* on the upstream side in the rotation direction R with respect to the leading-out member 38 flows toward the supporting member 32 when the container main body 31 is rotated in the rotation direction R. Therefore, the developer is guided into the leading through hole 51 and sent and discharged outside the developer container 30. As described above, even when the developer leaks out from the first retaining space 62*a* each time the container main body 31 is rotated round the rotation axis L31 in the rotation direction R by one revolution, the developer, which has leaked out, is held by the second retaining space 62*b*. Therefore, the predetermined quantity of the developer described before can be positively discharged outside.

Under the condition that the supporting base 49 is horizontally set, the discharge section 50, which protrudes in the one first horizontal direction F1, is formed in an upper portion of the supporting member 32. In the middle portion in the axial direction of the supporting member 32 in the discharge section 50, the leading through hole 51 is provided which penetrates in the one first horizontal direction F1 and is formed into an elliptical shape extending in a direction parallel with the axis L32 of the supporting member. Due to the foregoing, even when the container main body 31 is fully filled with the developer, the upper face 63*a* of the developer layer 63 is arranged at the same height as that of the leading through hole 51. Alternatively, the upper face 63*a* of the developer layer 63 is arranged at a lower position of the leading through hole 51. Therefore, it is possible to positively prevent the developer from undesirably leaking out from the container main body 31 into the leading through hole 51.

Figure 24:
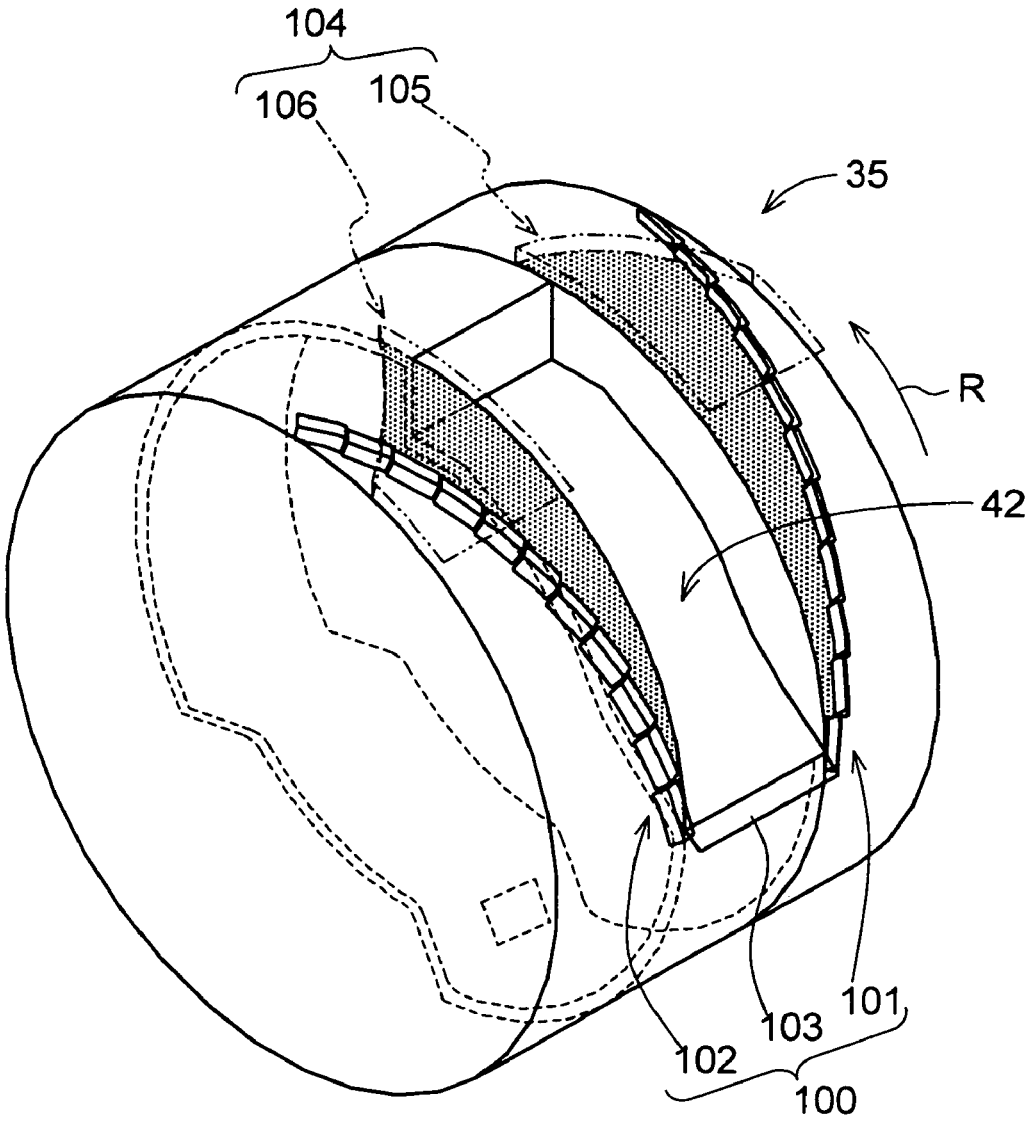
FIG. 24 is a perspective view showing the circumstances in which the container side guide portion and the supporting side guide portion cooperate with each other and developer is guided into the second concavity and the leading through hole.
Figure 25:
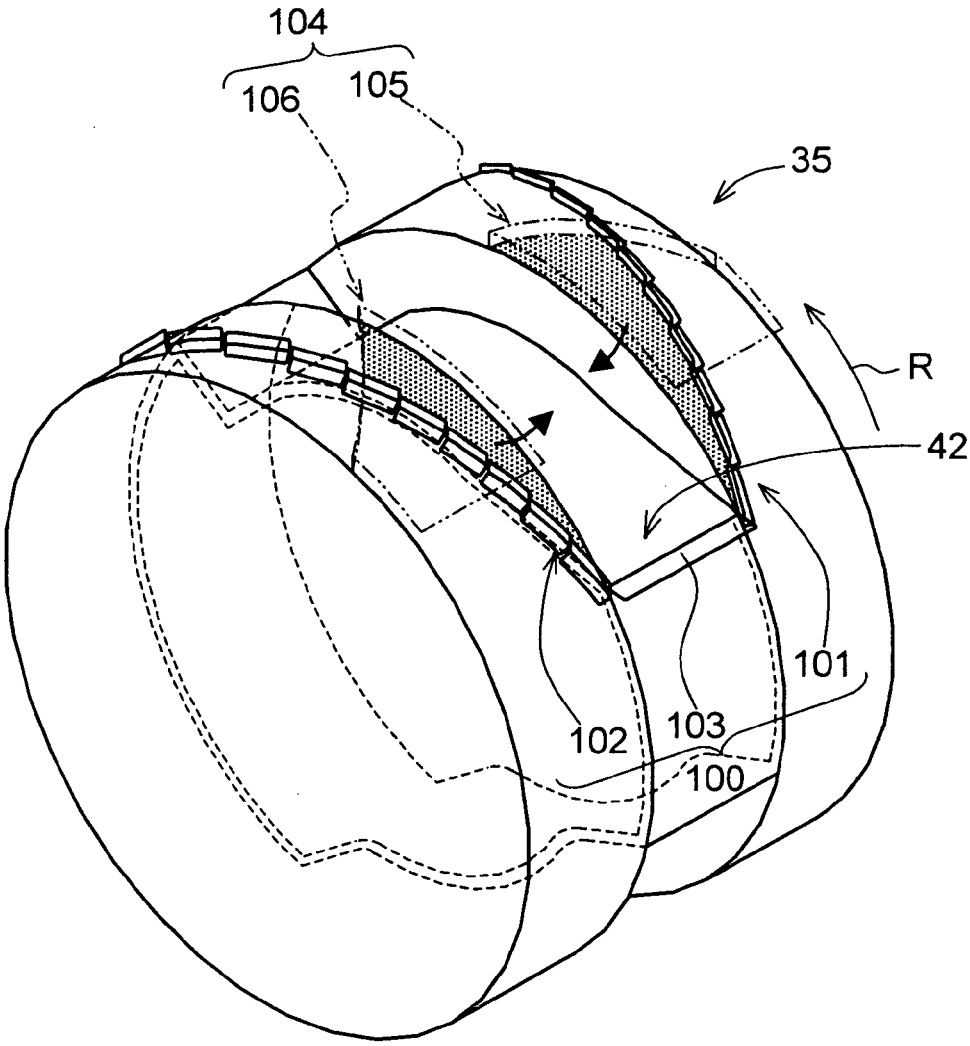
FIG. 25 is a perspective view showing the circumstances in which the container side guide portion and the supporting side guide portion cooperate with each other and developer is guided into the second concavity and the leading through hole.

FIGS. 24 and 25 are perspective views showing the circumstances in which the container side guide portion 100 and the supporting side guide portion 104 cooperate with each other and developer is guided into the second concavity 42 and the leading through hole 51. When the container main body 31 is rotated in the rotation direction R, the developer, which has gotten into between the third container segment 35 of the container main body 31 and the inner circumferential portion 48 of the supporting member 32 is first scraped off from the inner circumferential portion 48 of the supporting member 32 by the container side guide portion 100. Therefore, as shown in FIG. 24, the developer is prevented from moving onto one side and the other side in the axial direction of the container main body 31 and guided by the second concavity 42.

When the container main body 31 is further rotated, as shown in FIG. 25, the downstream side end portion in the rotation direction of the container side guide portion 100 and the upstream side end portion in the rotation direction of the supporting side guide portion 104 come into contact with each other, and the container side guide portion 100 and the inner circumferential portion 48 of the supporting member 32 cooperate with each other so that the developer can be held. The thus held developer is scraped off from the outer circumferential portion of the third container segment 35 by the supporting side guide portion 104 and guided into the second concavity 42 and the leading through hole 51.

In the first concavity 41, the developer in the container main body 31, which has been discharged from the discharge hole 43, is held. For example, when the container side guide portion is provided in the neighborhood of the first concavity 41, since the developer has already been held in the first concavity 41 as described before, there is a possibility that the developer between the third container segment 35 and the supporting member 32, which is guided by the container side guide portion, can not be held by the first concavity 41. Accordingly, when the container side guide portion 100 is provided in the neighborhood of the second concavity 42, the developer guided by the container side guide portion 100 is held by the second concavity 42 and guided into the leading through hole 51 by the rotation of the container main body 31.

Figure 26:
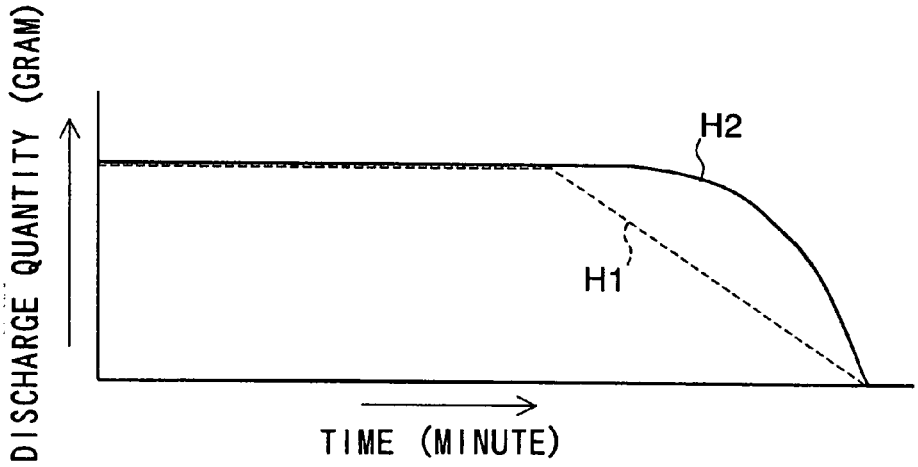
FIG. 26 is a graph showing a relation between the quantity of the developer discharged from the developer container and the time.

FIG. 26 is a graph showing a relation between the quantity of the developer discharged from the developer container 30 and the time. In FIG. 26, the curve H1 shows a relation between the quantity of the developer discharged from the developer container 30 and the time in the case where the inner diameter D35 of the third container segment 35 of the container main body 31 is not more than the inner diameters D33 and D34 of the first 33 and the second container segment 34. The curve H2 shows a relation between the quantity of the developer discharged from the developer container 30 and the time in the case where the inner diameter D35 of the third container segment 35 of the container main body 31 is larger than the inner diameters D33 and D34 of the first 33 and the second container segment 34.

Concerning the powder-like developer, even when the developer is extremely irregularly put on a horizontal plane, the surface of the developer immediately becomes flat. For example, in the case where the inner diameter D35 of the third container segment 35 of the container main body 31 is not more than the inner diameters D33 and D34 of the first 33 and the second container segment 34, the developer conveyed to the discharge port 43 by the rotation of the container main body 31 is separated from the discharge hole 43 when the container main body 31 stops rotating. In this case, when a quantity of the developer accommodated in the container main body 31 has become very small, it is difficult to convey a sufficiently large quantity of the developer to the discharge hole 43 immediately after the container main body 31 has started rotating again.

As shown in FIG. 8 explained before, in the embodiment, the inner diameter D35 of the third container segment 35 of the container main body 31 is larger than the inner diameters D33 and D34 of the first 33 and the second container segment 34 which are residual portions. Accordingly, in the case where a quantity of the developer accommodated in the container main body 31 becomes very small, it is possible to prevent the developer, which has once conveyed into the third container segment 35, from being separated from the third container segment 35. Due to the foregoing, even when a quantity of the developer accommodated in the container main body 31 has become very small, it is possible to convey a sufficiently large quantity of the developer toward the discharge hole 43 immediately after the container main body 31 has started rotating again. Further, all the developer accommodated in the container main body 31 can be discharged outside.

As shown by the curve H1, in the case where the inner diameter D35 of the third container segment 35 of the container main body 31 is not more than the inner diameters D33 and D34 of the first 33 and the second container segment 34, when a quantity of the developer accommodated in the container main body 31 is decreased, a quantity of the developer to be discharged is reduced corresponding to the reduction of the quantity of the developer accommodated in the container main body 31. On the other hand, as shown by the curve H2, in the case where the inner diameter D35 of the third container segment 35 of the container main body 31 is larger than the inner diameters D33 and D34 of the first 33 and the second container segment 34, even when a quantity of the developer accommodated in the container main body 31 is decreased as compared with the case of the curve H1, a quantity of the developer to be discharged can be maintained substantially constant until the quantity of the developer has become close to zero. Accordingly, when the developer container 30 of the embodiment is used, the developer can be stably discharged over a long period of time.

As described above, according to the developer container 30 of the embodiment, when the container main body 31 is driven being rotated round the axis L31, the developer accommodated in the container main body 31 can be conveyed in the axial direction by the conveying means provided in the inner circumferential portion of the container main body 31. In the case where the conveying means is provided like the first and the second prior art in which the conveying means extends in the spiral direction round the axis, for example, in the case where the conveying means is formed into projection pieces extending inward in the radial direction, or alternatively in the case where the conveying means is formed into a groove sinking outward in the radial direction, the developer located close to the conveying means is given a pushing force in the axial direction from the conveying means. Accordingly, there is a danger of the coagulation of the developer in the neighborhood of the projection pieces and the thus coagulated developer is sent to an image forming apparatus. Further, in this case, when the container main body is given a twisting force round the axis, a bending force or an impact from the outside, there is a danger of the occurrence of cracks extending in the spiral direction in the conveying means of the container main body, that is, there is a danger that the container main body is broken. In the case of the third prior art in which a plurality of conveying portions are formed at regular intervals in the circumferential and the axial direction, when portions between the conveying portions, which are adjacent to each other in the circumferential direction, are arranged on the same straight line or the same spiral line like the prior art, when the container main body is given a pushing force inward in the radial direction, the conveying portions, which are arranged on the same straight line or the same spiral, are compressed in the circumferential direction and deformed.

In the developer container 30 of the embodiment, the conveying means includes a plurality of the first projection pieces 36 extending in the first extending direction and the second projection pieces 39 extending in the second extending direction, and the projection pieces 36 and 39 are formed at regular intervals in the circumferential and the axial direction, and two projection pieces 36 and 39, which are adjacent to each other in the axial direction, are arranged in such a manner that the end portion on the downstream side in the rotation direction of one projection piece 36, 39 and the end portion on the upstream side in the rotation direction of the other projection piece 36, 39 adjoin each other in the axial direction. Therefore, the portions between the projection pieces 36 and 39, which are adjacent to each other in the circumferential direction, are not arranged on the same straight line or the same spiral line. Due to the foregoing, even when the container main body 31 is given a twisting force round the axis, a bending force or an impact from the outside and even when the container main body 31 is given a pushing force inward in the radial direction, the occurrence of damage and deformation of the container main body 31 can be prevented. Since the projection pieces 36, 39 are arranged at intervals in the circumferential direction, the developer conveyed in the axial direction by the projection pieces 36, 39 intermittently comes into contact with the projection pieces 36, 39. Therefore, the developer can be prevented from coagulation at the projection pieces 36, 39, and further the developer can be conveyed in the axial direction being oscillated. Due to the foregoing, the developer can be positively agitated in the rotating container main body 31 and made to come loose by the oscillation. Therefore, the developer can be positively prevented from being coagulated.

According to the developer container 30 of the embodiment, the container main body 31 can be rotated round the rotation axis L31 while being stably supported by the supporting member 32. When a cylindrical container of the prior art, in which the developer is accommodated, is left in the condition that the axis is set in the perpendicular direction to a horizontal plane, there is a possibility that the developer accommodated in a lower portion of the container coagulates. In order to prevent the coagulation of the developer described above, when the container is set on a horizontal plane so that the axis of the container can be parallel with the horizontal plane, the container rolls over. In the case of the developer container 30 of the embodiment, when the supporting base 49.*of* the supporting member 32 is arranged in a horizontal plane, the axis L31 of the container main body 31 can be stably arranged on the horizontal plane. Even when the developer accommodated in the developer container 30 is partially coagulated, for example, the developer can be easily agitated and made into powder-like when a user set the shutter 65*a* of the shutter portion 65 at the closing position P1 and rotates the container main body 31.

The faces 33*c*, 34*c*, on which the outer circumferential faces and the end faces of both end portions 33*a*, 34*a* in the axial direction of the container main body 31 are communicated with each other, are formed into a curved face which inclines inward in the radial direction as described before. Therefore, even when the user arranges either of both end portions 33*a*, 34*a* in the axial direction of the container main body 31 on the horizontal face and sets the developer container 30 on the horizontal plane so that the axis L31 can become perpendicular to the horizontal plane, the developer container 30 will easily fall down. Due to the foregoing, it is possible for the user to be prevented from leaving the developer container 30 as it is under the condition that the developer container 30 is perpendicularly set in such a manner that the axis L31 is set in the perpendicular direction to the horizontal face. Therefore, it is possible to reduce the cause of coagulation of the accommodated developer.

According to the developer container 30 of the embodiment, the supporting member 32 supports a portion of the container main body 31 at least including the third container segment 35 from the outside in the radial direction all over the circumference. Further, two sealing materials 47 are provided between the container main body 31 and the supporting member 32 so that sealing can be accomplished as described above. Therefore, even when the container main body 31 is rotated, the developer can be prevented from leaking out from between the container main body 31 and the supporting member 32.

According to the developer container 30 of the embodiment, the container main body 31 includes a container side guide portion 100 for guiding the developer from between the outer circumferential portion of the third container segment 35 of the container main body 31 and the inner circumferential portion 48 of the supporting member 32 into the second concavity 42 by the rotation of the container main body 31, the container side guide portion 100 elastically coming into contact with the inner circumferential portion 48 of the supporting member 32, the container side guide portion 100 being arranged in the neighborhood of the second concavity 42 on one side and the other side in the axial direction of the outer circumferential portion of the third container segment 35 of the container main body 31. By the container side guide portion 100, even when the developer between the outer circumferential portion of the third container segment 35 of the container main body 31 and the inner circumferential portion 48 of the supporting member 32 is going to stay at the position or leak out by the rotation of the container main body 31, the developer can be guided to the second concavity 42. Therefore, it is possible to prevent the developer from staying at the position or leaking outside. Due to the foregoing, it is possible to prevent the occurrence of a problem in which the rotation of the container main body 31 is blocked when the developer stays between the outer circumferential portion of the third container segment 35 of the container main body 31 and the inner circumferential portion 48 of the supporting member 32. Accordingly, the developer can be stably discharged from the leading through hole.

According to the developer container 30 of the embodiment, in the neighborhood of the leading through hole 51 of the inner circumferential portion 48 of the first supporting portion 55 of the supporting member 32, the supporting side guide portion 104 is provided which guides the developer between the outer circumferential portion of the third container segment 35 of the container main body 31 and the inner circumferential portion 48 of the supporting member 32 into the leading through hole 51. By the supporting side guide portion 104, even when the developer between the outer circumferential portion of the third container segment 35 of the container main body 31 and the inner circumferential portion 48 of the supporting member 32 is going to stay at the position or leak out by the rotation of the container main body 31, the developer can be guided to the leading through hole 51. Therefore, it is possible to prevent the developer from staying at the position or leaking outside. When the supporting side guide portion 104 and the container side guide portion 100 cooperate with each other, it becomes possible to prevent the container main body 31 from being blocked by the developer staying between the outer circumferential portion of the third container segment 35 of the container main body 31 and the inner circumferential portion 48 of the supporting member 32, and the developer can be stably, positively discharged from the leading through hole 51.

According to the developer container 30 of the embodiment, a quantity of the developer to be discharged is determined by the volume of the first retaining space 62*a* and the rotation speed of the container main body 31. In the developer container 30 of the embodiment, concerning the concavity, two concavities of the first and second concavities 41 and 42 are provided, and the discharge hole 43 is provided only in the first concavity 41. However, the invention is not limited to the above specific embodiment. For example, in the case where it is wanted that a quantity of the developer to be discharged per one revolution of the container main body 31 is increased, the second concavity 42 may be formed into the same shape as that of the first concavity 41, and the discharge hole 43 may be provided. In this connection, the number of the concavities and the number of the discharge holes may be further increased.

In the embodiment, the conveying means includes: a first projection piece 36 extending in the first extending direction round the axis L31 and protruding inward in the radial direction; and a second projection piece 39 extending in the second extending direction round the axis L31 and protruding inward in the radial direction. However, the invention is not limited to the above specific embodiment. For example, the conveying means may be grooves which sink outward in the radial direction and extend in the first extending direction and the second extending direction and are provided in the circumferential direction and the axial direction at intervals.

Figure 27:
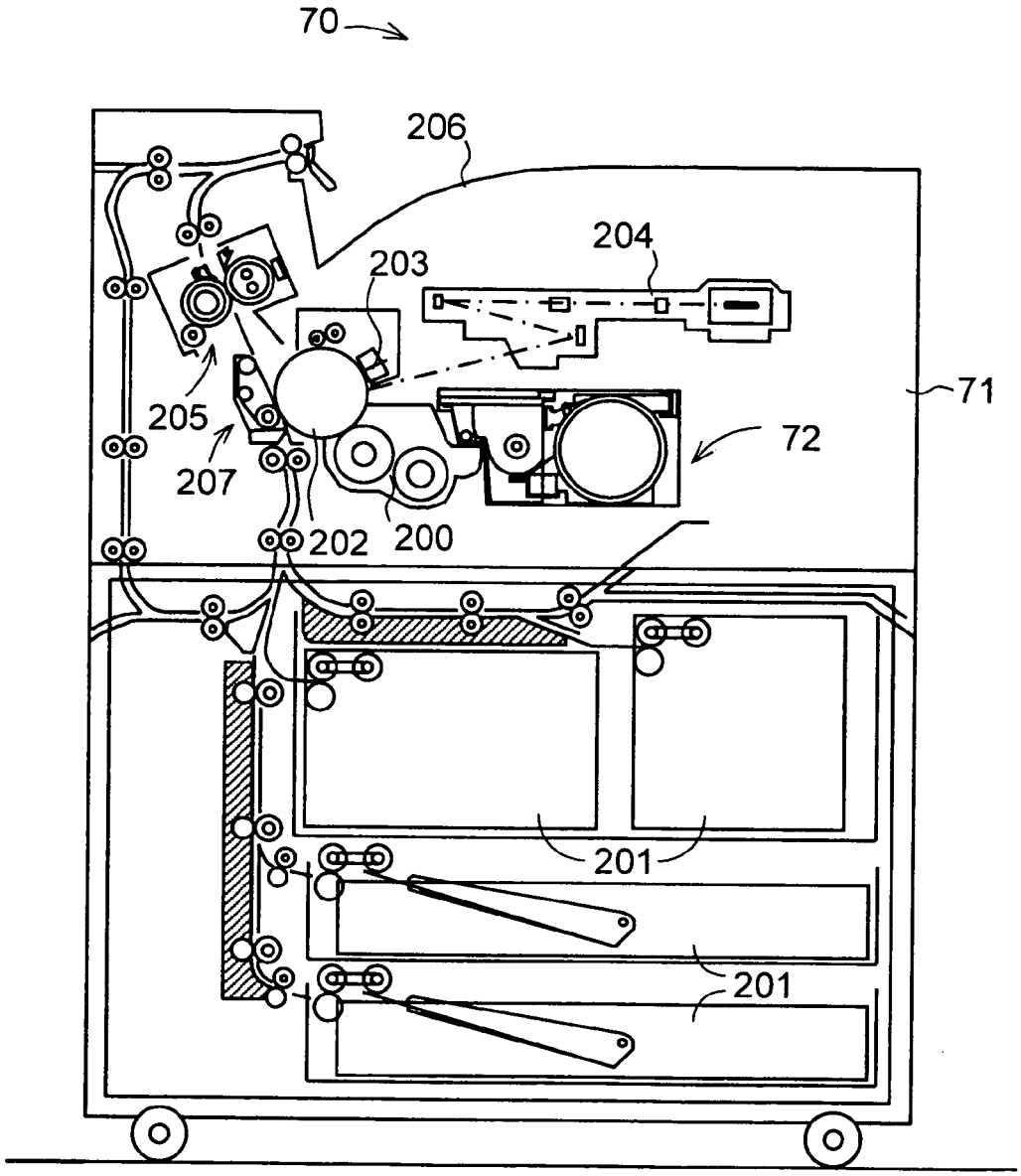
FIG. 27 is a sectional view showing an image forming apparatus according to another embodiment of the invention.

FIG. 27 is a sectional view showing an image forming apparatus 70 of another embodiment of the invention.

Figure 28:
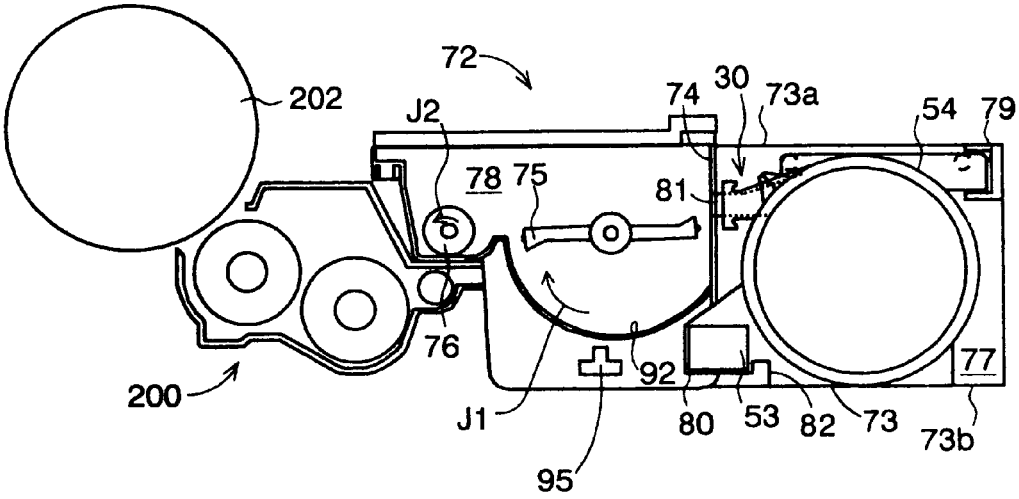
FIG. 28 is an enlarged sectional view showing a neighborhood of a toner hopper.
Figure 29:
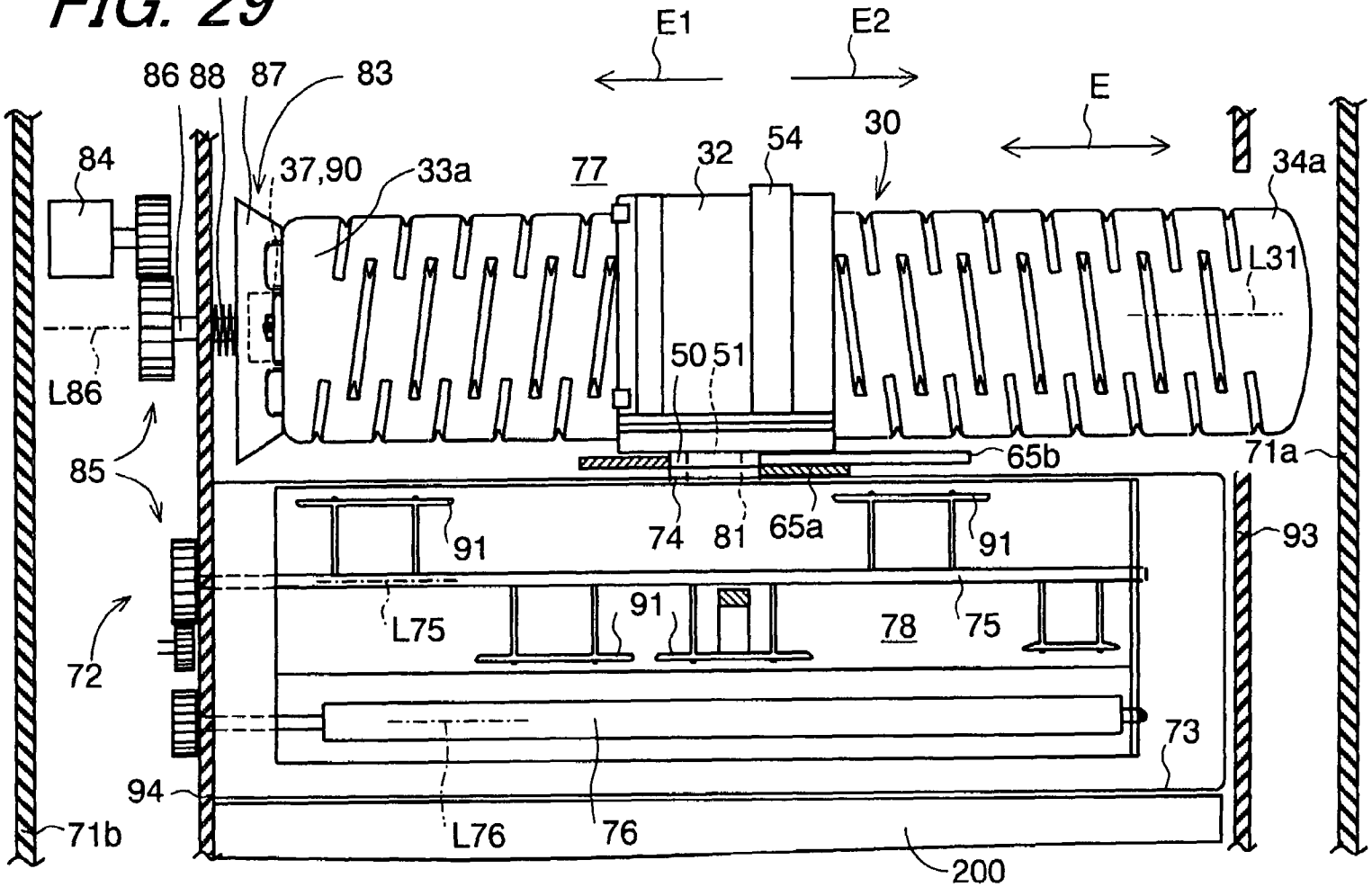
FIG. 29 is an enlarged plan view showing a neighborhood of the toner hopper.

FIG. 28 is an enlarged sectional view showing a neighborhood of the toner hopper 72. FIG. 29 is an enlarged plan view showing the neighborhood of the toner hopper 72. FIG. 27 is a sectional view of the image forming apparatus 70, wherein the view is taken from the front-side exterior portion 71*a* side. In order to make the comprehension easy, the thickness is omitted in the view. The front-side exterior portion 71*a* is defined as a portion that is faced by a user when the user uses the image forming apparatus 70. A back-side exterior portion 71*b* is defined as a portion in the image forming apparatus 70 that is located on the rear side to the front-side exterior portion 71*a* when the user sees the apparatus from the front-side exterior portion 71*a* side. In this case, the image forming apparatus 70 is installed on a horizontal plane. The front to the rear direction E, which is directed from the front-side exterior portion 71*a* to the back-side exterior portion 71*b*, is parallel with the horizontal plane.

The image forming apparatus 70 of the electrophotographic recording type such as a printer or copier includes: a developer container 30 of the first embodiment; and an image forming apparatus main body 71 which will be referred to as "an apparatus main body" hereinafter. The developer container 30 is detachably attached to the toner hopper 72, which is provided in the apparatus main body 71, via a container attaching opening (not shown) which can be freely opened and closed and is provided in the front face outer packing portion 71*a* of the apparatus main body 71. In the image forming apparatus main body 71, a cabinet front portion 93 is provided on the back-side exterior portion 71*b* side with respect to the front-side exterior portion 71*a*. Further, in the image forming apparatus 71, an opening portion penetrating the apparatus in the thickness direction is formed, and the developer container 30 can be inserted into this opening portion. In the image forming apparatus main body 71, a cabinet back portion 94 is provided on the front-side exterior portion 71*a* side with respect to the back-side exterior portion 71*b*. Each component of the image forming apparatus main body 71 is held by the housing, some portions of which are illustrated in the drawing, including the cabinet front portion 93 and the cabinet back portion 94.

The toner hopper 72 includes: a housing 73; a developer supply section 74; an agitation member 75; and a supply roller 76. The inner space of the housing 73 is divided into at least a container housing space 77 and an agitation space 78 by the developer supply section 74. The container housing space 77 is open facing the front-side exterior portion 71*a* of the apparatus main body 71. The agitation space 78 is a substantially closed space. The developer container 30 is arranged in the container housing space 77.

In the upper wall portion 73*a* of the housing 73 facing the container housing space 77, the first guide concavity 79, into which the second guide piece 54 of the supporting member 32 of the developer container 30 can be engaged, is formed. This first guide concavity 79 extends in the front to rear direction E of the apparatus main body 71. The second guide piece 54 of the supporting member 32 of the developer container 30 can be engaged with the first guide concavity 79 so that the second guide piece 54 can be slid in the longitudinal direction, in other words, in the direction parallel with the front to the rear direction E of the apparatus main body 71 and in the attaching direction E1 directed from the front-side exterior portion 71*a* to the back-side exterior portion 71*b* and in the detaching direction E2 which is opposite to the attaching direction E1. In the lower wall portion 73*b* opposed to the upper wall portion 73*a* of the housing 73 facing the container housing space 77, the second guide concavity 80, into which the first guide piece 53 of the supporting member 32 of the developer container 30 can be engaged, is formed. This second guide concavity 80 extends in the front to the rear direction E of the apparatus main body 71. The first guide piece 53 of the supporting member 32 of the developer container 30 can be engaged with the second guide concavity 80 so that the first guide piece 53 can be slid in the longitudinal direction, in other words, in the attaching direction E1 of the apparatus main body 71 and in the detaching direction E2 which is opposite to the attaching direction E1.

The developer supply section 74 is a plate-shaped member for dividing the inner space of the housing 73 into the container housing space 77 and the agitation space 78. The developer supply section 74 includes a communication hole 81 which penetrates the developer supply section 74 in the thickness direction and communicates the container housing space 77 with the agitation space 78. In a lower portion of the communication hole 81 of the developer supply section 74, a guide member 82 protruding into the container housing space 77 is provided.

Figure 30:
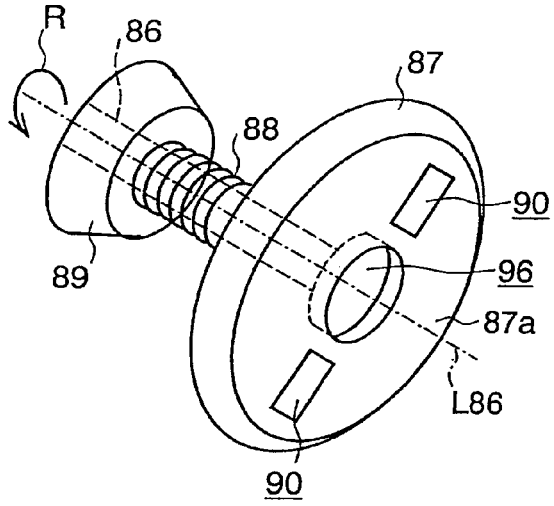
FIG. 30 is an enlarged perspective view showing a main body-side coupling section.
Figure 31:
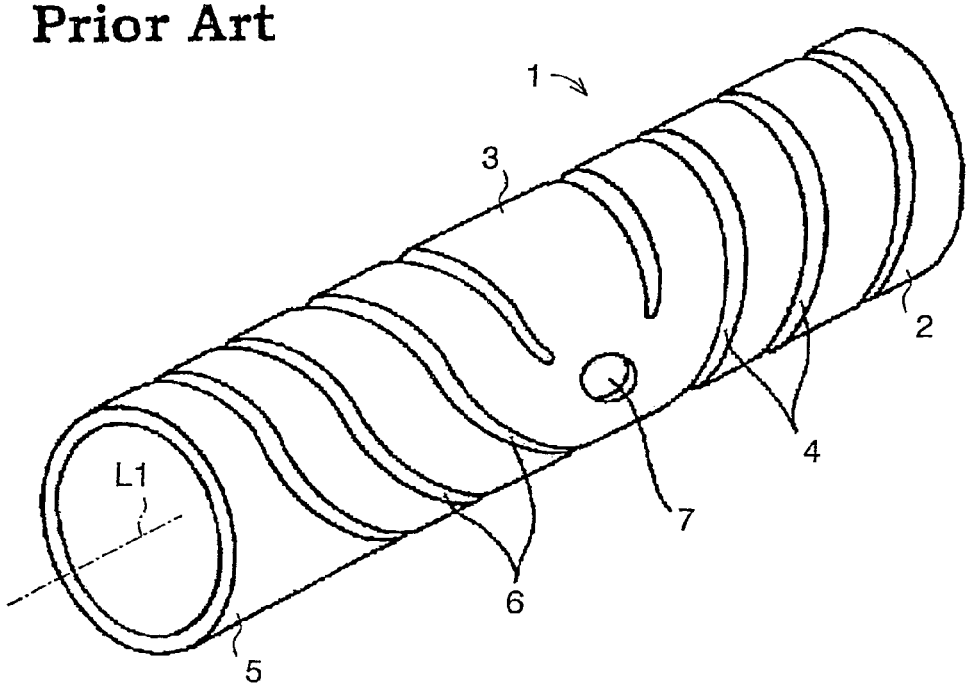
FIG. 31 Prior Art
FIG. 31 is a perspective view showing a conventional developer supplying container.
Figure 32:
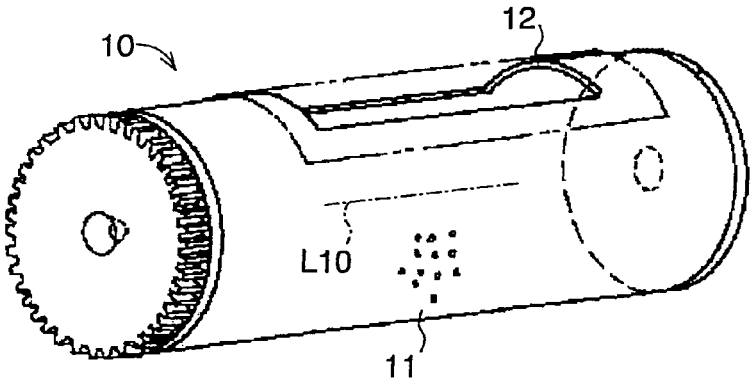
FIG. 32 Prior Art
FIG. 32 is a perspective view showing another conventional toner cartridge.

FIG. 30 is an enlarged perspective view showing a main body-side coupling section 83. A drive force generated by the driving source 84 such as an electric motor of the apparatus main body 71 for rotating the container main body 31 of the developer container 30 is transmitted to the main body-side coupling section 83 via the speed reduction device 85 such as gears. The drive means includes: the main body-side coupling section 83; a driving source 84; and a speed reduction device 85. The main body-side coupling section 83 includes: a rotation shaft 86; a coupling support 87; and a spring member 88. The rotation shaft 86 is arranged in such a manner that the axis L86 is parallel with the front to the rear direction E of the apparatus main body 71 and the rotation shaft 86 is pivotally inserted into a bearing 89 which is provided penetrating the cabinet back portion 94, which is the rear wall portion of the housing 73 on the back-side exterior portion 71*b* side of the apparatus main body 71, in the thickness direction. The free end portion of the rotation shaft 86 is arranged in the container housing space 77.

The coupling support 87 is formed into a substantial disk shape and faces the container housing space 77. The coupling support 87 is integrated with the rotation shaft 86 into one body and freely rotated round the axis L86 and connected to an free end portion of the rotation shaft 86. At the center of the surface portion 87*a* opposite to the surface portion facing the cabinet back portion 94 of the coupling support 87, an auxiliary concavity 96, the axis of which is the same as the axis L86 of the rotation shaft 86, is provided which sinks onto the cabinet back portion 94 side, into which the replenishment port 45, to which the replenishment lid 46 of the developer container 30 is attached, can be engaged. Outside in the radial direction with respect to the auxiliary concavity 96 of the surface portion 87*a* of the coupling support 87, a plurality of concave fits 90, in the embodiment, two concave fits 90 are formed, which are arranged at the symmetrical positions with respect to the axis L86 of the rotation shaft 86 and sink onto the cabinet back portion 94. The shape of each concave fit 90 corresponds to the shape of each convex fit 37 of the container main body 31. When each convex fit 37 of the container main body 31 is engaged into the concave fit 90, the convex fit 37 and the concave fit 90 are engaged with each other.

The coupling support 87 can be freely displaced in the axial direction of the rotation shaft 86 without being disengaged from the free end portion of the rotation shaft 86. The spring member 88 composed of a compression spring is arranged between the cabinet back portion 94 and the coupling support 87 and gives a spring force in the direction so that the coupling support 87 can be separated from the cabinet back portion 94 without blocking the rotation of the rotation shaft 86 and the coupling support 87. The one end portion 33*a* in the axial direction including the convex fit 37 of the container main body 31 of the developer container 30 and the coupling support 87 of the main body-side coupling section 83 compose a coupling structure. Accordingly, the convex fit 37 of the container main body 31 can be detachably connected to the coupling support 87 of the main body-side coupling section 83.

When the developer container 30 is attached to the apparatus main body 71, the developer container 30 is set so that the rotation axis L31 can be parallel with the attaching direction E1, and the front-side exterior portion 71*a* of the apparatus main body 71 is inserted into the container housing space 77 of the toner hopper 72. At this time, the second guide piece 54 of the supporting member 32 of the developer container 30 is engaged in the first guide concavity 79 of the housing 73, and the first guide piece 53 of the supporting member 32 is engaged in the second guide concavity 80 of the housing 73, so that the supporting member 32 can not be displaced in directions except for the attaching direction E1 and the detaching direction E2 of the supporting member 32. Under the above condition, the developer container 30 is displaced in the attaching direction E1 and arranged at the attaching position where the leading through hole 51 of the discharge portion 50 of the supporting member 32 and the communication hole 81 of the developer supply section 74 are communicated with each other. At this time, the coupling support 87 of the main body-side coupling section 83 is pushed in the attaching direction E1 by the convex fit 37 of the container main body 31, so that the coupling support 87 can be contracted and the spring portion 88 can be compressed.

The toner hopper 72 includes a regulating member (not shown) for regulating and releasing a displacement of the supporting member 32 in the attaching direction E1 and the detaching direction E2 under the condition that the developer container 30 is arranged at the attaching position. After all developer accommodated in the developer container 30 has been discharged, the user releases the regulation against the supporting member 32 made by the regulation member, and the developer container 30 is displaced in the detaching direction E2, so that the developer container 30 can be detached from the apparatus main body 71.

In the periphery of the communication hole 81, which faces the container housing space 77 of the developer supply section 74 of the toner hopper 72, a shutter displacement means (not shown) for sliding the shutter 65*a* of the shutter portion 65 of the developer container 30 is provided. When the developer container 30 is inserted from the front packing portion 71*a* of the apparatus main body 71 into the container housing space 77 of the toner hopper 72 while the rotation axis L31 and the attaching direction E1 are being made to be parallel to each other, the shutter 65*a* arranged at the closing position P1 is slid in the one second horizontal direction B1 by the shutter displacement means. When the developer container 30 is arranged at the attaching position, the shutter 65*a* is arranged at the opening position P2. When the developer container 30, which is attached to the apparatus main body 71 and arranged at the attaching position, is displaced in the detaching direction E2 so as to detach the developer container 30 from the apparatus main body 71, the shutter 65*a* arranged at the opening position P2 is slid in the other second horizontal direction B2 by the shutter displacement means and arranged at the closing position P1.

At least in the periphery of the leading through hole 51 of the discharge portion 50 of the supporting member 32 of the developer container 30 or in the periphery of the communication hole 81, which faces the container housing space 77, of the developer supply section 74 of the toner hopper 72, a sealing material (not shown) is provided which prevents the developer, which flows down from the leading through hole 51 to the communication hole 81, from leaking out to portions except for the agitation space 78.

As shown in FIG. 29, in the apparatus main body 71, the developing portion 200 is arranged at the middle portion in the front to the rear direction E. The reason is that the photoreceptor drum 202 of the apparatus main body 71 is arranged in the middle portion in the front to the rear direction E of the apparatus main body 71. The driving source 84 and the drive portion such as a speed reduction gear 85 for rotating the main body-side coupling section 83, the agitation member 75 and the supply roller 76 are arranged between the cabinet back portion 94 and the rear face packing portion 71*b* in the apparatus main body 71. Accordingly, under the condition that the developer container 30 is arranged at the attaching position, the supporting member 32 of the developer container 30 is arranged in the middle portion in the front to the rear direction E of the apparatus main body 71. In the developer container 30, as described before, the length from the supporting member 32 of the container main body 31 to the end face of one end portion 33*a* in the axial direction, in which the convex fit 37 is formed, is shorter than the length from the supporting member 32 to the end face of the other end portion 34*a* in the axial direction.

In the case of the developer container 30 of the image forming apparatus 70 of the embodiment, the supporting member 32 is arranged in the middle portion in the axial direction of the container main body 31. Therefore, under the condition that the developer container 30 is attached to the attaching position in the image forming apparatus main body 71, the supporting member 32 is arranged in the middle portion in the front to the rear direction E of the apparatus main body 71. Due to the foregoing, the container main body 31 can be extended from the middle portion in the front to the rear direction E to the front portion of the apparatus main body 71. Further, the container main body 31 can be extended from the middle portion in the front to the rear direction E to the rear face, that is, the capacity of the container main body 31 can be greatly increased. In the embodiment, as shown in FIG. 29, the other end portion 34*a* in the axial direction of the developer container 30 protrudes to the front packing portion 71*a* side compared with the cabinet front portion 93.

When the length from the supporting member 32 of the container main body 31 to the end face of one end portion 33*a* in the axial direction is made to be shorter than the length from the supporting member 32 to the end face of the other end portion 34*a* in the axial direction, it is possible to ensure a region in which the driving source 84 connected to the convex fit 37 of one end portion 33*a* in the axial direction of the container main body 31 and the drive portion including the speed reduction gear 85 are provided. As described above, the developer container 30 can provide matchless effects in which the space in the apparatus main body 71 is effectively utilized and a quantity of the developer accommodated in the developer container 30 is increased as large as possible.

In the case where the driving source 84 is driven and the coupling support 87 is rotated under the condition that the developer container 30 is arranged at the attaching position, when the concave fit 90 of the coupling support 87 and the convex fit 37 of the developer container 30 are engaged with each other, the container main body 31 is rotated round the rotation axis L31 as it is. When the concave fit 90 of the coupling support 87 and the convex fit 37 of the developer container 30 are not engaged with each other, until the concave fit 90 of the coupling support 87 and the convex fit 37 of the developer container 30 are engaged with each other, only the coupling support 87 is angularly displaced for a while. When the concave fit 90 of the coupling support 87 and the convex fit 37 of the developer container 30 are engaged with each other, a spring force generated by the spring member 88 is given, so that the concave fit 90 of the coupling support 87 and the convex fit 37 of the developer container 30 are closely engaged with each other. Thus, the container main body 31 is rotated round the rotation axis L31. When the container main body 31 of the developer container 30 is rotated round the rotation axis L31, the developer accommodated in the developer container 30 is supplied to and accommodated in the agitation space 78 via the leading through hole 51 of the discharge portion 50 of the supporting member 32 and via the communication hole 81 of the developer supply section 74 of the toner hopper 72.

The agitation member 75 and the supply roller 76 are arranged in the agitation space 78 at an interval being extended in the front to the rear direction E of the apparatus main body 71. The agitation member 75 can be freely rotated round the agitation axis L75 which is parallel with the front to the rear direction E. The agitation member 75 includes a flexible scraper member 91 extending in the direction of the agitation axis L75. The agitation member 75 is rotated by a drive force, which is given by the driving source 84 arranged in the apparatus main body 71, round the agitation axis L75 in the clockwise direction J1 when it is viewed from the front of the apparatus main body 71. The supply roller 76 can be freely rotated round the supply axis L76 which is parallel with the front to the rear direction E. For example, the outer circumferential face of the supply roller 76 is made of porous resin such as sponge. The supply roller 76 is rotated by a drive force, which is given by the driving source 84 arranged in the apparatus main body 71, round the agitation axis L75 in the counterclockwise direction J2 when it is viewed from the front of the apparatus main body 71.

An agitation wall portion 92 is provided facing the agitation space 78 of the toner hopper 72. The agitation wall portion 92 communicates with the developer supply section 74, extends in the front to the rear direction E of the apparatus main body 21, the cross section perpendicular to the agitation axis L75 of the agitation member 75 of which is a substantial U-shape, and is formed into a partially cylindrical inner circumferential shape which is open upward. The developer is supplied from one communication hole 81 into the agitation space 78. However, as described before, the developer discharged from the developer container 30 is not only agitated but also mixed with gas and formed into fine powder. Therefore, the fluidity of the developer is very high. Accordingly, only when the developer is supplied from the communication hole 81, the developer can be diffused in the direction of the agitation axis L75 in the agitation space 78. The developer accommodated in the agitation space 78 is further diffused in the direction of the agitation axis L75 in the agitation space 78 by the agitation of the agitation member 75.

When the agitation member 75 is rotated, the developer, which has been supplied from the communication hole 81 and accommodated in the agitation space 78, is agitated. At the same time, while the free end portion of the scraper member 91 is coming into contact with the agitation wall portion 92, the scraper member 91 scrapes out the developer accommodated in the agitation space 78 and gives the developer to the supply roller 76. Accordingly, the supply roller 76 is given the fine-powder-like developer substantially uniformly in the axial direction L76. Even when a quantity of the remaining developer accommodated in the agitation space 78 has become small, the remaining developer is scraped off and given to the supply roller 76. Therefore, a quantity of the developer, which remains in the agitation space 78 without being given to the supply roller 76, can be decreased as small as possible. The developer given to the supply roller 76 can be supplied to the developing portion 200 in an excellent condition by the rotation of the supply roller 76.

The apparatus main body 71 includes: a development section 200; a recording sheet cassette 201; a photoconductive drum 202; a charging section 203; a laser exposure section 204; a transfer section 207 and a fixating section 205. In the development section 200, the toner, which is developer supplied from the toner hopper 72, and the carrier, which is magnetic particles previously prepared, are agitated so that two-component developer can be generated.

The recording sheet cassette 201 holds recording sheets on which images are formed. The photoconductive drum 202 is a cylindrical drum, on the outer circumference of which the photoreceptor is provided, and rotated round the axis by a drive force given from the drive portion. The charging section 203 applies electric charge to the photosensitive element of the photoconductive drum 202 to achieve the photosensitization. In the laser exposure section 204, the photoconductive element of the photoconductive drum 202 bearing electrical charge is exposed to laser light to form an electrostatic latent image on the photoconductive element.

In the development section 200, the two-component developer is agitated and then fed to the photoconductive element of the photoconductive drum 202 on which an electrostatic latent image is developed. Thus, development is conducted. Thereby, a toner image corresponding to the electrostatic latent image is formed. The transfer section 207 transfers the toner image formed on the photoconductive drum 202 onto a recording sheet supplied from the recording sheet cassette 201. In the fixating section 205, the toner image, which has been transferred onto the recording sheet, is fixed. The recording sheet, on which the toner image has been formed and fixed, is discharged into a discharge tray 206. In order to maintain the concentration of toner in two-component developer in the development section 200 constant, the outer circumferential portion of the supply roller 76 is made of sponge, and further the rotation of the supply roller 76 is controlled. Due to the foregoing, the supply roller 76 can supply an appropriate quantity of fine-powder-like toner to the development section 200.

Brief descriptions will be made into the container main body 31 of the developer container 30. Brief descriptions will be also made into the controlling of the agitation member 75 of the toner hopper 72 and the supply roller 76. A toner remaining quantity detector 95 is provided in the agitation wall portion 92. When the toner remaining quantity detector 95 detects that a quantity of developer (referred to as "toner" hereinafter) accommodated in the agitation space 78 of the toner hopper 72 has become small, the control portion not shown controls the driving source 84 and rotates the container main body 31 of the developer container 30, so that the toner can be supplied into the agitation space 78. When it is detected by the toner remaining quantity detector 95 that a quantity of the toner accommodated in the agitation space 78 is not full even when the container main body 31 is rotated for a predetermined period of time, the control portion stops the rotation of the container main body 31 and displays a message in a display portion not shown which means that the developer container 30 is to be exchanged. Therefore, the user is informed of this message. At this point of time, a suitable quantity of toner is accommodated in the agitation space 78 of the toner hopper 72. During the period of time in which the developer is still accommodated in the agitation space 78 of the toner hopper 72, the user detaches the empty developer container 30 from the apparatus main body 71 and attaches a new developer container 30, in which the developer is accommodated, to the apparatus main body 71. Due to the foregoing, even in the middle of image formation on the sheet of recording paper conducted by the image forming apparatus 70, since the developer necessary for image formation is accommodated in the agitation space 78 of the toner hopper 72, the developer can be replenished to the apparatus main body 71 without interrupting the image forming operation.

In the embodiment, when the developer is replenished, it is sufficient that only the developer container 30 is exchanged. For example, the user holds the supporting member 32 and the second container segment 34 of the developer container 30 and inserts from the first container segment 33, in which the convex fit 37 is formed, into the container housing space 77 of the toner hopper 72 from the cabinet front portion 93 of the apparatus main body 71 in the attaching direction E1. Therefore, the attaching work is very simple. When the developer container 30 is detached from the apparatus main body 71, the user only holds the second container segment 34 of the developer container 30 and draws in the detaching direction E2. Therefore, the detaching work is very simple.

In order to prevent the occurrence of coagulation of the accommodated developer by agitation, it is conventional that the user oscillates a heavy and large toner cartridge in the vertical and the horizontal direction. However, in the case of the developer container 30 of the embodiment, it is sufficient that the user only rotates the container main body 31 round the rotation axis L31. Therefore, the operation is very simple. Further, according to the developer container 30 of the embodiment, the structure of agitating the accommodated developer is very simple. Furthermore, sealing can be accomplished between the container main body 31 and the supporting member 32. In the case where the developer container 30 is attached to the apparatus main body 71 at the attaching position, sealing is accomplished at least in the periphery of the leading through hole 51 of the discharge portion 50 or in the periphery of the communication hole 81 of the developer supply section 74, wherein the leading through hole 51 and the communication hole 81 are communicated with each other. Therefore, the developer can be prevented from leaking out from the container housing space 77 of the toner hopper 72. Accordingly, when the user exchanges the developer container 30, it is possible for the user to prevent the hand from being stained with the developer. Since the developer container 30 is substantially cylindrical, it is possible to accommodate the developer container 30 in a long and slender rectangular parallelepiped packing box. Accordingly, the developer container 30 can be very easily transported and replenished.

As described before, according to the developer container 30, a necessary torque for rotating the container main body 31 is not so high, and further a quantity of the developer discharged per one revolution of the container main body 31 is constant. Therefore, it is unnecessary to increase the rotation speed of the container main body 31. Even at a low rotation speed of the container main body 31, the developer can be supplied into the agitation space 78 of the toner hopper 72. While a quantity of the developer discharged from the container main body 31 per one revolution is being maintained constant, the developer can be supplied into the agitation space 78. Further, an intensity of torque of the driving source 84 can be reduced. Therefore, for example, the driving source 84 can be a small electric motor.

In the developer container 30 and the image forming apparatus 70 of the embodiment described before, two-component developer is used. However, it should be noted that the invention can be applied to the developing system in which only toner is used.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and the range of equivalency of the claims are therefore intended to be embraced therein.

What is claimed is:

1. A developer container that is detachably mounted on an image forming apparatus, comprising:

a container main body for accommodating developer used for image formation, formed into a cylindrical shape, a concavity sinking inward in the radial direction being formed in an outer circumferential portion of the container main body, a discharge hole for discharging developer being formed in the container main body, the developer accommodated in the container main body being conveyed to the discharge hole when the container main body is rotated round its axis;

a supporting member for covering a portion including at least the concavity and the discharge hole from the outside in the radial direction all over the circumference, for supporting the container main body so that the container main body can be freely rotated round its axis, the supporting member being formed facing a moving passage of the concavity by the rotation of the container main body, a leading through hole for guiding the developer discharged from the discharge hole of the container main body to the outside being provided in the supporting member; and a container side guide portion for guiding the developer from between the outer circumferential portion of the container main body and the inner circumferential portion of the supporting member into the concavity by the rotation of the container main body, the container side guide portion elastically coming into contact with the inner circumferential portion of the supporting member, the container side guide portion being arranged in a neighborhood of the concavity on one side and the other side in the axial direction of the outer circumferential portion of the container main body.

2. The developer container of claim 1, wherein the container side guide portion is arranged so that the container side guide portion can come close to the concavity as it comes to an upstream side in the rotation direction.

3. The developer container of claim 1, wherein the container side guide portion is formed into a sheet-shape having flexibility and elasticity, the container side guide portion protrudes outside in the radial direction, and a free end portion of the container side guide portion elastically comes into contact with the inner circumferential portion of the supporting member.

4. The developer container of claim 3, wherein the container side guide portion includes a plurality of guiding pieces protruding outside in the radial direction.

5. The developer container of claim 1, further comprising a supporting side guide portion for guiding the developer from between the outer circumferential portion of the container main body and the inner circumferential portion of the supporting member into the leading through hole, the supporting side guide portion being arranged in a neighborhood of the leading through hole of the inner circumferential portion of the supporting member.

6. The developer container of claim 5, wherein the supporting side guide portion is formed into a sheet-shape having flexibility and elasticity and protrudes inward in the radial direction, and a free end portion of the supporting side guide portion elastically comes into contact with the outer circumferential portion of the container main body.

7. An image forming apparatus into which the developer container of claim 1 is detachably incorporated.

* * * * *